US007365708B2

(12) United States Patent
Nagao et al.

(10) Patent No.: US 7,365,708 B2
(45) Date of Patent: Apr. 29, 2008

(54) PLASMA DISPLAY AND ITS DRIVING METHOD

(75) Inventors: Nobuaki Nagao, Katano (JP); Toru Ando, Osaka (JP); Masaki Nishimura, Takatsuki (JP); Yuusuke Takada, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 366 days.

(21) Appl. No.: 10/480,186

(22) PCT Filed: Jun. 11, 2002

(86) PCT No.: PCT/JP02/05771

§ 371 (c)(1),
(2), (4) Date: Jul. 19, 2004

(87) PCT Pub. No.: WO02/101707

PCT Pub. Date: Dec. 19, 2002

(65) Prior Publication Data

US 2004/0239588 A1 Dec. 2, 2004

(30) Foreign Application Priority Data

Jun. 12, 2001 (JP) ..... 2001-176584

(51) Int. Cl.
*G09G 3/28* (2006.01)

(52) U.S. Cl. ..... 345/60; 345/67; 345/68; 345/66

(58) Field of Classification Search ..... 345/60–69; 315/169.1–169.4; 313/450, 574, 633
See application file for complete search history.

(56) References Cited

U.S. PATENT DOCUMENTS

| | | | | |
|---|---|---|---|---|
| 6,011,355 | A | 1/2000 | Nagai | |
| 6,020,687 | A | 2/2000 | Hirakawa et al. | |
| 6,124,849 | A | 9/2000 | Ito et al. | 345/204 |
| 6,249,087 | B1 | 6/2001 | Takayama et al. | 315/169.1 |
| 6,294,875 | B1 | 9/2001 | Kurata et al. | |
| 6,603,447 | B1 | 8/2003 | Ito et al. | |
| 2004/0246205 | A1* | 12/2004 | Choi | 345/60 |
| 2005/0127846 | A1* | 6/2005 | Kim | 315/169.4 |
| 2005/0156821 | A1* | 7/2005 | Hashimoto et al. | 345/60 |

(Continued)

FOREIGN PATENT DOCUMENTS

CN 1271155 A 10/2000

(Continued)

*Primary Examiner*—Vijay Shankar

(57) ABSTRACT

A plasma display device that enables a stable address operation even in a high-speed drive so as to display an image of high definition and high quality. A PDP having discharge cells each provided with a scanning electrode and a sustaining electrode is driven by a method for displaying a frame of an image by repeating an address period, a discharge sustaining period, and a discharge suspend period. At least one initialization period that succeeds a discharge suspend period and in which the state of the wall charge in each discharge cell is initialized is provided. In the discharge suspend period, a voltage is applied between the scanning electrode and the sustaining electrode so that a wall voltage may be generated at which the polarity at the scanning electrode with respect to the sustaining electrode is the same as that of the initializing pulse applied to the scanning electrode in the initialization period.

31 Claims, 17 Drawing Sheets

U.S. PATENT DOCUMENTS

| | | | | |
|---|---|---|---|---|
| 2005/0195135 | A1* | 9/2005 | Moon | 345/67 |
| 2006/0214882 | A1* | 9/2006 | Jung et al. | 345/60 |

FOREIGN PATENT DOCUMENTS

| | | |
|---|---|---|
| JP | 7-175438 | 7/1995 |
| JP | 9-62225 | 3/1997 |
| JP | 10-149774 | 6/1998 |
| JP | 10-274955 | 10/1998 |
| JP | 11-85099 | 3/1999 |
| JP | 11-133913 | 5/1999 |
| JP | 2000-214822 | 8/2000 |
| JP | 2001-05423 | 1/2001 |
| JP | 2001-13911 | 1/2001 |
| JP | 2001-052618 | 2/2001 |
| JP | 2001-093426 | 4/2001 |
| JP | 2001-272948 | 10/2001 |
| JP | 2002-014648 | 1/2002 |
| KR | 2000-0053573 | 8/2000 |

* cited by examiner

PLASMA DISPLAY AND ITS DRIVING METHOD

TECHNICAL FIELD

The present invention relates to a plasma display device that is used as the display screen for computers, televisions and the like, and a method of driving the plasma display device.

BACKGROUND ART

Recently, plasma display panels (hereafter referred to as PDPs) have become a focus of attention for their ability to realize a large, slim, and lightweight display device for use in computers, televisions and the like.

PDPs can be broadly divided into two types: direct current (DC) and alternating current (AC). Of these, AC PDPs are at present the dominant type.

In a typical surface discharge AC PDP, a front substrate and a back substrate are placed in parallel so as to face each other. Scanning electrodes and sustaining electrodes are formed in parallel strips on an inward-facing surface of the front substrate, and also covered by a dielectric layer. Data electrodes are formed in parallel strips perpendicular to the scanning electrodes, on an inward-facing surface of the back substrate. The space between the front substrate and the back substrate is divided into smaller spaces by the stripe ribs. Discharge gas is sealed in these spaces. Discharge cells are formed in the space between the substrates, at the points where the scanning electrodes and the data electrodes intersect, the discharge cells as a whole thus forming a matrix.

When driving a PDP, as shown in FIG. 17, each discharge cell is turned on or off through a sequence of periods: an initialization period in which all discharge cells are initialized by applying an initialize pulse; an address period in which pixel information is written by applying a data pulse to data electrodes that are selected from all of the data electrodes while sequentially applying a scan pulse to the scanning electrodes; a discharge sustain period in which light is emitted by sustaining a main discharge by applying a rectangular-wave sustain pulse to a space between the scanning electrodes and the sustaining electrodes; and an erase period (discharge suspend period) in which wall voltage of the discharge cells is erased.

Each discharge cell is fundamentally only capable of two display states, on and off. Here, an in-field time division gray scale display method in which one frame (one field) is divided into a plurality of sub-fields and the on and off states in each sub-field are combined to express a gray scale is used for driving the plasma display device.

The PDP, as well as other types of displays in general, is becoming to have higher definition. With this tendency, a number of scanning lines increases (e.g. 768 scanning lines for an XGA PDP), and accordingly, a number of write operation also increases.

Normally, widths of a scan pulse and the write pulse for the write operation are defined as about 2–2.5 μs. If the number of the write operation increases, then the address period becomes longer accordingly, and an address period for an XGA PDP may take 1.5–1.9 ms.

Existing VGA PDPs are such that one TV field includes 13 subfields (SFs). If the address period becomes longer, it is inevitable that a number of SFs included in one TV field is reduced to around 8–10, and the reduced number of SFs causes degradation in an image quality.

In response to the above noted problem, an attempt has been made such as making a write pulse width short and performing the address operation in a high speed. For example, the write pulse width for a high-end hi-vision display is defined as short as 1–1.3 μs (highly minute with the number of scanning lines being 1080).

However, setting the write pulse width too short causes a write defect and degradation in the image quality, because discharge may not be completed within a time period of the write pulse, and wall charge by the address discharge is not sufficiently accumulated.

DISCLOSURE OF THE INVENTION

It is therefore the object of the present invention to provide a plasma display device and a method of driving the same that is capable of displaying high-definition and high-quality images by enabling a stable address operation even in a high-speed drive.

In order to achieve the above object, a plasma display device of the present invention is such that the plasma display device comprising a plasma display panel and a driving unit that drives the plasma display panel, the plasma display panel having a first substrate on which a plurality of pairs of a first electrode and a second electrode are disposed and a second substrate on which a plurality of third electrodes are disposed, a plurality of discharge cells being formed between the first and second substrates so as to each include a part of each of the first, second, and third electrodes, wherein the driving unit: (a) repeatedly provides, in order for the plasma display panel to display one frame of image, (i) an address period in which a wall charge is accumulated in one or more of the discharge cells by selectively applying pulses to the first and third electrodes, (ii) a sustain period that succeeds the address period and in which the selected discharge cells are discharged by applying a sustain pulse between the first and second electrodes, a polarity of the sustain pulse at the first electrodes with respect to the second electrodes alternating between positive and negative, and (iii) a discharge suspend period in which the discharging of the selected discharge cells is suspended, (b) provides at least one initialization period that succeeds the discharge suspend period and in which an initialize pulse is applied to the first electrodes to initialize the wall charge in the discharge cells, and (c) applies, when the initialization period is provided, a voltage between the first and second electrodes in the discharge suspend period, so as to form a wall voltage whose polarity at the first electrodes with respect to the second electrodes is the same as that of the initialize pulse.

In the initialization period, a positive polarity pulse is usually applied, and in this case, "the same (polarity) as that of the initialize pulse" refers to the positive polarity.

It is preferable that an absolute value of the wall voltage formed between the first and second electrodes in the discharge suspend period is in a range from 10 V to (Vmin-30) V inclusive.

By this, a period of time for the initializing discharge becomes longer because the voltage in the discharge cells reach the firing voltage Vf more quickly. Also, because the initialization is carried out to the outer edges of a discharge cell, the address discharge in an succeeding address period becomes stable, a discharge probability becomes high, and thus an image quality is improved.

Possible examples in which a voltage is applied between the first and the second electrodes in the discharge suspend period are different between the cases where the sustain pulse applied at an end of the sustaining period preceding the initialization period is negative at the first electrodes with respect to the second electrodes, and positive at the first electrodes with respect to the second electrodes.

It is also possible that a polarity of the initialize pulse applied in the initialization period is positive, the polarity of the sustain pulse is negative at an end of the sustain period, and a voltage between the first and second electrodes in the discharge suspend period is applied so that a wall voltage formed in the sustain period partially remains.

In this case, examples for applying between the first and the second electrodes in the discharge suspend period receding to the initialization period are as follows.

The driving unit applies an erase pulse between the first and second electrodes in the discharge suspend period, the erase pulse being positive in polarity at the first electrodes with respect to the second electrodes and narrower in pulse width than the sustain pulse.

It is preferable that a pulse width of the erase pulse is 0.2 μs to 2.0 μs inclusive The driving unit applies a bias voltage between the first and second electrodes in the discharge period at the same time when the erase pulse is applied, the bias voltage being positive in polarity at the first electrodes with respect to the second electrode and lower in wave height than the sustain pulse.

It is preferable that an absolute value of the bias voltage is in a range from 10 V to (Vmin-40) V inclusive.

It is also preferable that a waveform of the bias voltage has a ramp rise part, in which the voltage gradually increases after the erase pulse has ended.

The driving unit applies an erase pulse between the first and second electrodes in the discharge suspend period, the erase pulse being positive in polarity at the first electrodes with respect to the second electrodes and having a starting ramp immediately after application of the erase pulse is commenced.

It is preferable that a starting speed of the erase pulse is 0.5 V/μs to 20 V/μs inclusive.

On the other than, it is also possible that a polarity of the initialize pulse applied in the initialization period is positive, the polarity of the sustain pulse is positive at an end of the sustain period, and a voltage between the first and second electrodes in the discharge suspend period is applied so that a polarity of a wall voltage formed in the sustain period is reversed.

In this case, examples for applying between the first and the second electrodes in the discharge suspend period are as follows.

The driving unit applies an erase pulse between the first and second electrodes in the discharge suspend period, the erase pulse being negative in polarity at the first electrodes with respect to the second electrodes and narrower in pulse width than the sustain pulse.

It is preferable that a pulse width of the erase pulse is 0.2 μs to 2.0 μs inclusive.

The driving unit applies a bias voltage between the first and second electrodes in the discharge period at the same time when the erase pulse is applied, the bias voltage being negative in polarity at the first electrodes with respect to the second electrode and lower in wave height than the sustain pulse.

It is preferable that a waveform of the bias voltage has a ramp rise part, in which the voltage gradually increases after the erase pulse has ended.

The driving unit applies an erase pulse between the first and second electrodes in the discharge suspend period, the erase pulse being negative in polarity at the first electrodes with respect to the second electrodes and having an ending ramp immediately before the initialization period starts.

It is preferable that waveforms of the ending ramp of the erase pulse and a starting ramp of the initialize pulse are continuous.

The driving unit applies an erase pulse between the first and second electrodes in the discharge suspend period, the erase pulse being negative in polarity at the first electrodes with respect to the second electrodes, having a starting ramp immediately after application of the erase pulse is commenced, and lower in wave height than a firing voltage Vf.

Especially, in a PDP in which each of the first and second electrodes in the discharge cells is divided into a plurality of electrode lines along a lengthwise direction, an address operation could become unstable when driven in a high speed. Accordingly, it is effective to adopt the above described driving method.

BEST MODE FOR CARRYING OUT THE INVENTION

[Overview of Construction of PDP and Driving Method]

Figure 1:
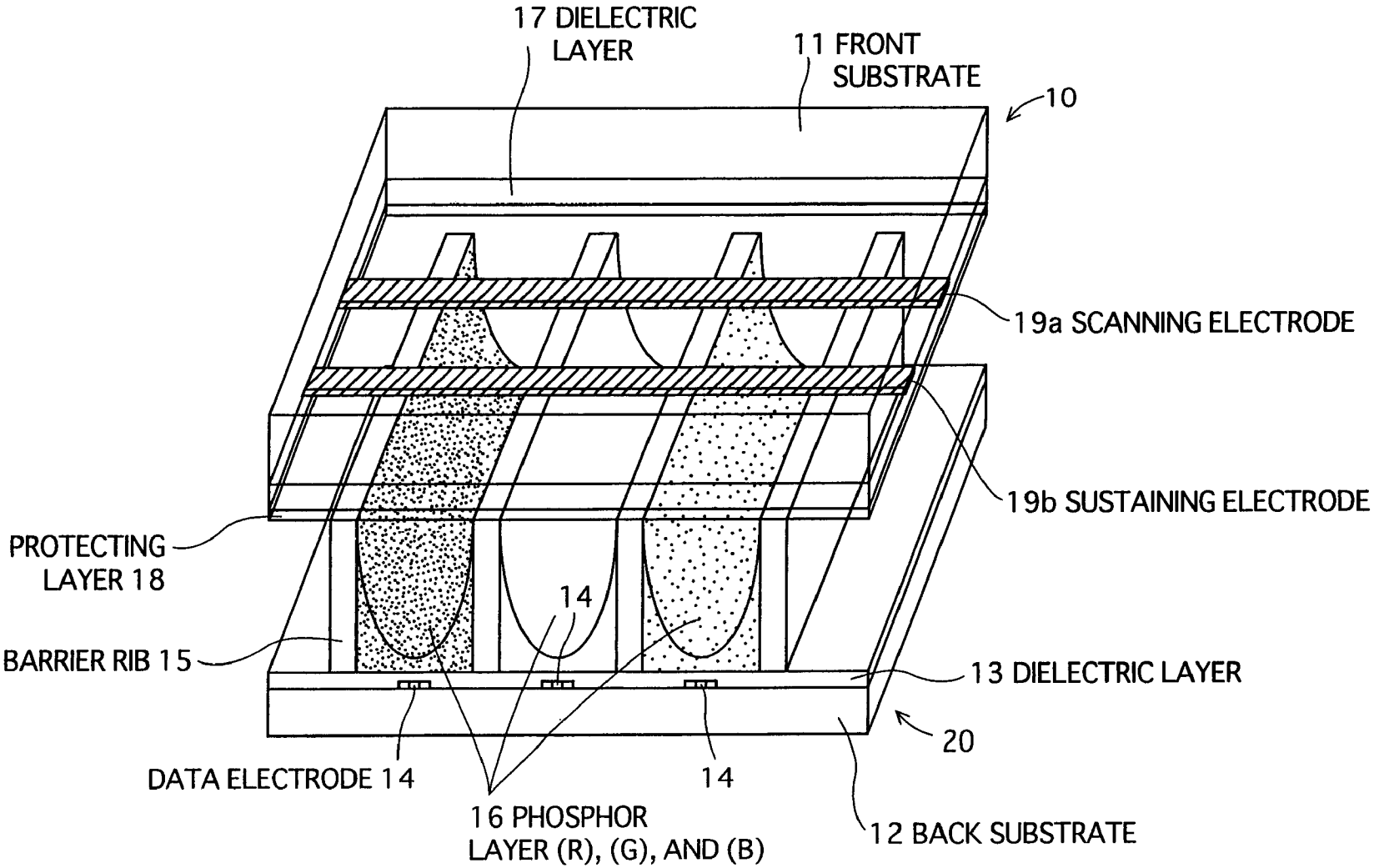
FIG. 1 is a perspective view schematically illustrating a partial construction of a surface discharge AC PDP relating to embodiments of the present invention.

FIG. 1 is a perspective view schematically illustrating a partial construction of a surface discharge AC PDP relating to embodiments of the present invention.

The PDP of the embodiments includes a front panel 10 in which scanning electrodes (first electrodes) 19*a*, sustaining electrodes (second electrodes) 19*b*, a dielectric layer 17, and a protecting layer 18 are disposed on a front substrate 11, and a back panel 20 in which data electrodes (third electrodes) 14, a dielectric layer 13, and barrier ribs 15 in stripes are disposed on a back substrate 12. The front panel 10 and the back panel 20 are positioned in parallel with a space therebetween so that the electrodes 19*a*, 19*b*, and the data electrodes 14 face each other.

The space between the front panel 10 and the back panel 20 is generally around 100–200μm. The barrier ribs 15 partition the space so as to form discharge spaces, and a discharge gas is enclosed in each of the discharge spaces.

In order for color display, phosphor layers 16 are each disposed between the barrier ribs 15 on the back panel 20. The phosphor layers 16 are positioned in an order of red, green, and blue, and exposed to the discharge space.

The scanning electrodes 19*a*, the sustaining electrodes 19*b*, and the data electrodes 14 each are disposed in stripes. The scanning electrodes 19*a* and the sustaining electrodes 19*b*, for example, are such that metal electrodes 191 and 194 are layered on transparent electrodes 192 and 193, respectively. The data electrodes 14 are made only of metal electrodes.

The dielectric layer 17 is a layer made of dielectric material that covers an entire surface of the front substrate 11 and electrodes 19*a* and 19*b*. Commonly used material for such a dielectric layer is lead low-melting glass or bismuth low-melting glass.

The protecting layer 18 is a thin layer made of material having a high secondary emission coefficient, such as MgO, and covers an entire surface of the dielectric layer 13.

The barrier ribs 15 are made of glass material, and disposed on the back substrate 12 so as to extend from the surface thereof.

In a color PDP, a gas mixture composed mainly of xenon is used as the discharge gas, emitting ultra-violet light when a discharge is caused. In a monochrome PDP, a gas mixture composed mainly of neon is used as the discharge gas, emitting visible light when a discharge is caused. A pressure at which the discharge gas is enclosed is normally set in a range of 200–500torr (26.6–66.5 kPa) so that the pressure in an interior of the panels becomes lower than the external pressure, assuming that the PDP is used under the atmospheric pressure.

Figure 2:
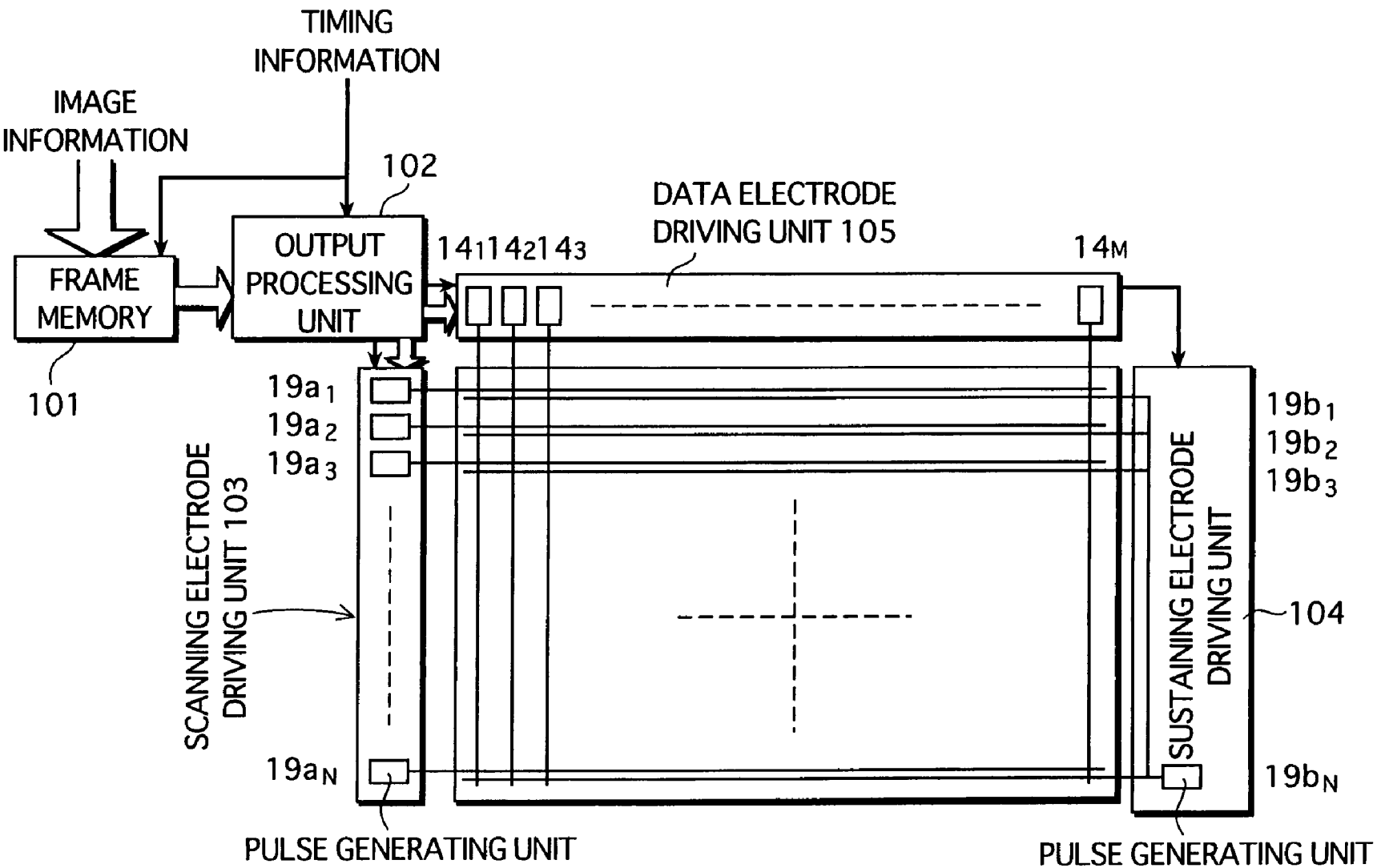
FIG. 2 is a block diagram illustrating a configuration of electrodes in the PDP and driving circuits that drives the PDP.

FIG. 2 is a block diagram illustrating a configuration of electrodes in the above described PDP and driving circuits that drives the PDP.

The electrodes $\mathbf{19}a_1$–$\mathbf{19}a_N$ and $\mathbf{19}b_1$–$\mathbf{19}b_N$ are arranged at right angles to the data electrodes $\mathbf{14}_1$–$\mathbf{14}_M$. Discharge cells are formed in the space between the front substrate 11 and the back substrate 12, at the points where the electrodes intersect. Each discharge cell include a scanning electrode 19*a*, sustaining electrode 19*b*, and a data electrode 14. A pixel is formed by three discharge cells (red, green, and blue) that are next to each other in a direction that the scanning electrodes $\mathbf{19}a_1$–$\mathbf{9}a_N$ and the sustaining electrodes $\mathbf{19}b_1$–$\mathbf{19}b_N$ extend.

The PDP is fundamentally only capable of two display states, on and off, and an in-field time division gray scale display method to express a gray scale is used for driving the PDP.

Figure 3:
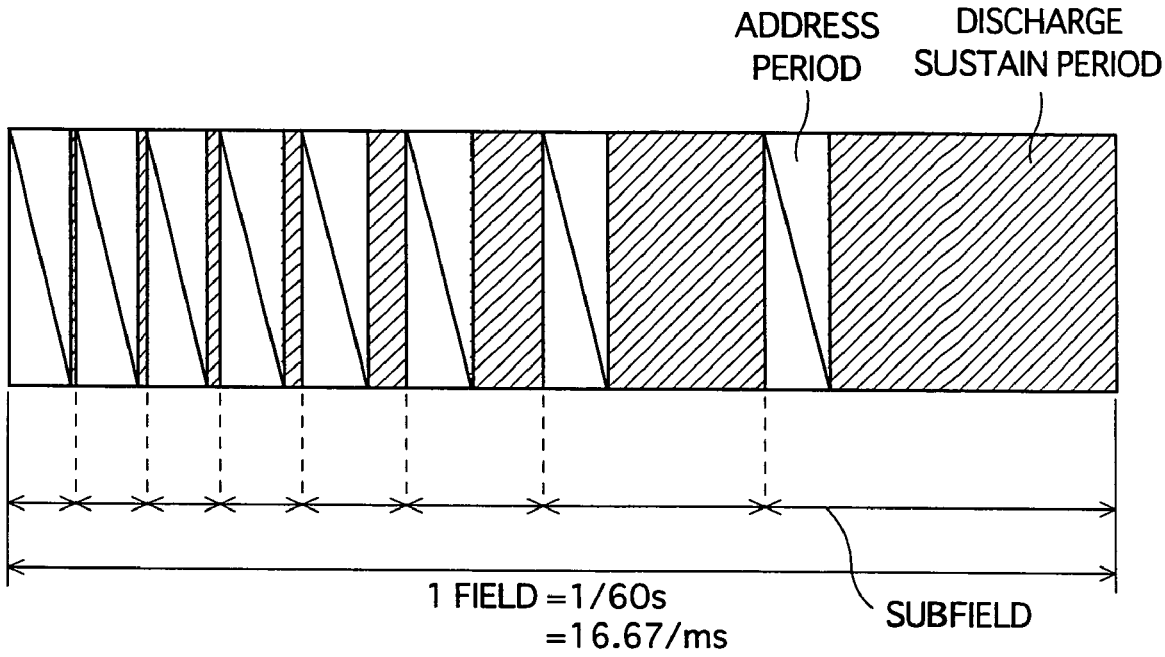
FIG. 3 shows an example of a field division method for one field when a 256-level gray scale is expressed.

FIG. 3 shows an example of a division method for one field when a 256-level gray scale is displayed. A horizontal axis shows time and shaded parts show discharge sustain periods.

In the example of the division method shown in FIG. 3, one field is made up of eight subfields. A proportion of time length of each discharge sustain period in the eight subfields is set at 1, 2, 4, 8, 16, 32, 64, and 128, respectively. These eight-bit binary combinations express 256 gray scale levels. The NTSC (National Television System Committee) standard for television images stipulates a field rate of 60 fields per second, and therefore, the time length for one field is set at 16.7 ms.

Each subfield is composed of a sequence including an initialization period (not shown in the drawing), an address period, a discharge sustain period, and a discharge suspend period(not shown in the drawing). An image for one field is displayed by repeating an operation for one subfield for 8 times.

The initialization period may be included in each subfield, or only in a first subfield in one field.

[Driving Circuit]

As shown in FIG. 2, the driving circuit includes a frame memory 101 for storing input image data; an output processing unit 102 for processing the image data; a scanning electrode driving apparatus 103 for applying a pulse to the scanning electrodes $\mathbf{19}a_1$–$\mathbf{19}a_N$; a sustaining electrode driving apparatus 104 for applying a pulse to the sustaining electrodes $\mathbf{19}b_1$–$\mathbf{19}b_N$; and a data electrode driving apparatus 105 for applying a pulse to the data electrodes $\mathbf{14}_1$–$\mathbf{14}_M$.

The frame memory 101 stores pieces of subfield image data that are generated by dividing image data for one field and each of the pieces of subfield image data corresponds to each of the subfields.

The output processing unit 102 outputs current subfield image data, which is stored in the frame memory 101, to the data electrode driving apparatus 105 line by line. The output processing unit 102 also sends a trigger signal, which provides pulse application timing, to the electrode driving apparatuses 103–105, based on the timing information (for example, a horizontal sync signal or a vertical sync signal) that synchronizes with the input image information.

The scanning electrode driving apparatus 103 has pulse generation circuits that correspond to the scanning electrodes on a one-to-one basis and are driven in response to trigger signals sent from the output processing unit 102. This construction enables a scan pulse to be applied in sequence to all of the scanning electrodes $\mathbf{19}a_1$–$\mathbf{19}a_N$ in the address period, and initialization and sustain pulses to be applied to all of the scanning electrodes $\mathbf{19}a_1$–$\mathbf{19}a_N$ at once in the initialization and sustain periods, respectively.

The sustaining electrode driving apparatus 104 has pulse generation circuits that are driven in response to trigger signals sent from the output processing unit 102 and apply sustain pulse to all of the sustaining electrodes $\mathbf{19}b_1$–$\mathbf{19}b_N$ at once in the sustain and discharge suspend periods, respectively.

The data electrode driving apparatus 105 has pulse generation circuits that are driven in response to trigger signals sent from the output processing unit 102, and apply a write pulse to data electrodes selected from the data electrodes $\mathbf{14}_1$–$\mathbf{14}_M$, based on the subfield information.

The scanning electrode driving apparatus 103 or the sustaining electrode driving apparatus 104 also have pulse generation circuits that generates an erase pulse, a bias voltage, and such, in the discharge suspend period in response to trigger signals sent from the output processing unit 102.

[Operation in Each Period]

Figure 4:
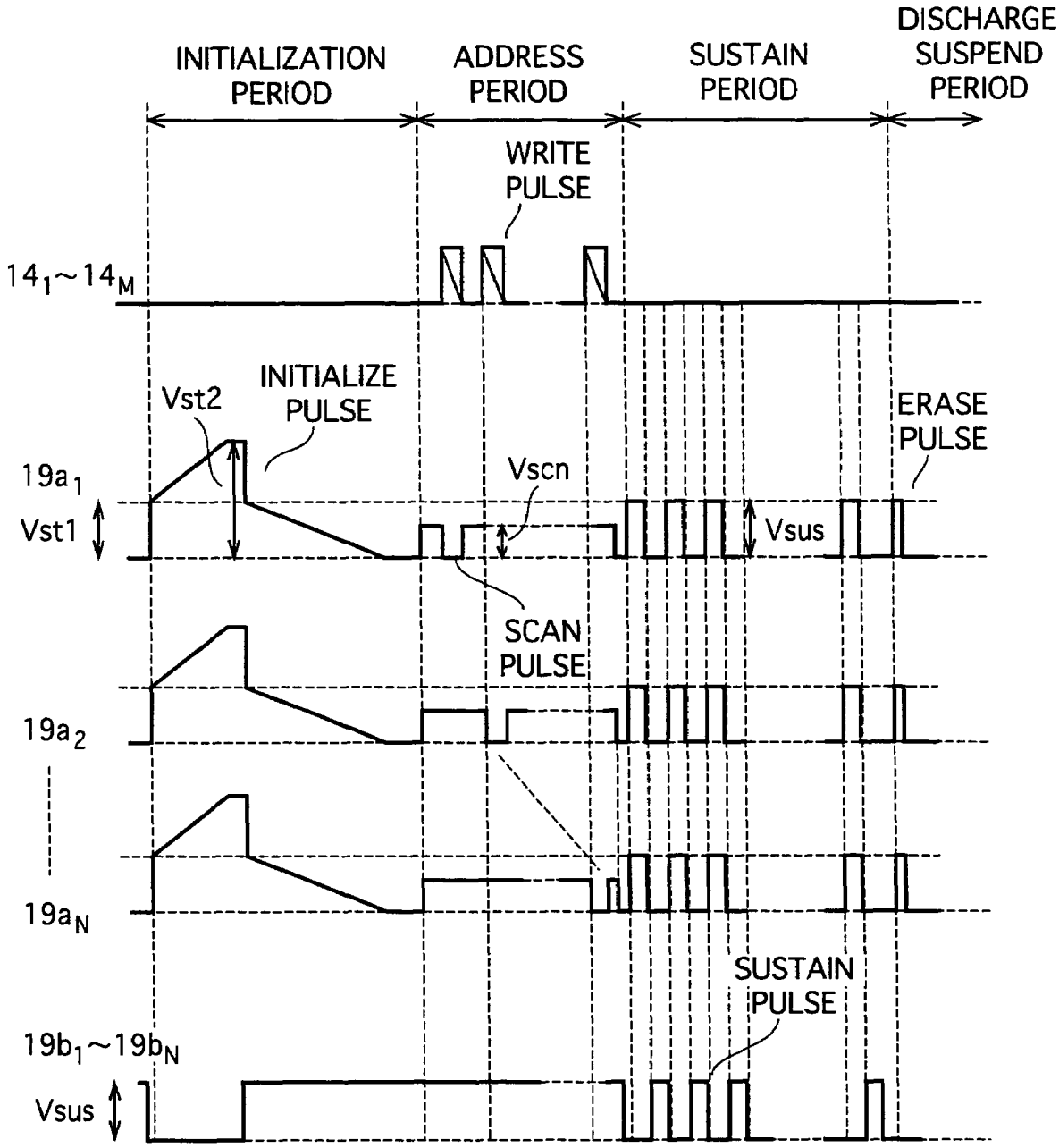
FIG. 4 shows a driving waveform of a voltage applied to each electrode in the PDP in a first embodiment.

FIG. 4 shows a driving waveform of a voltage applied to each electrode in the PDP in a first embodiment.

Figure 5:
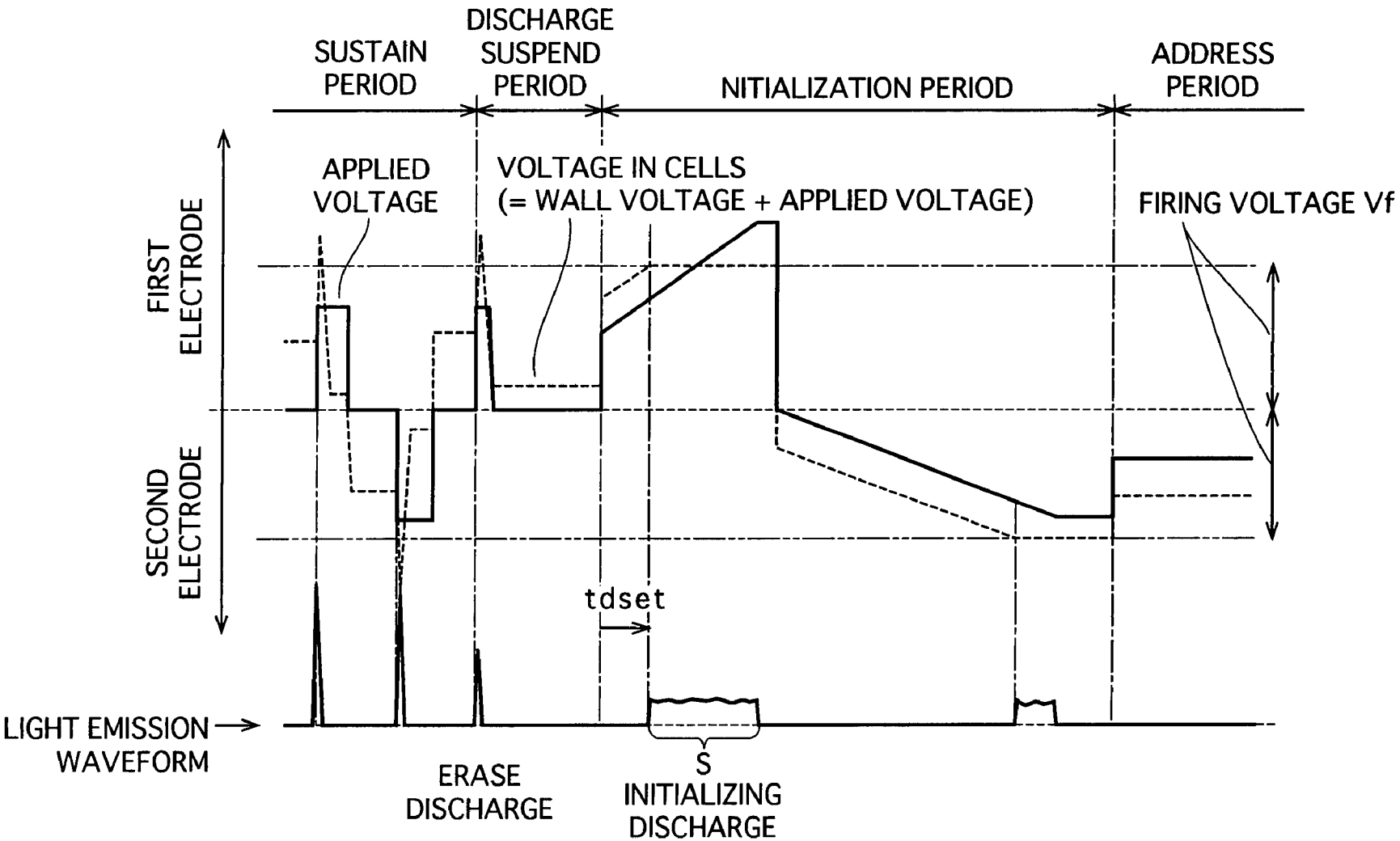
FIG. 5 is a time chart showing a waveform of a differential voltage between first electrodes and second electrodes, a voltage in cells, and a light-emission waveform.

FIG. 5 is a time chart showing a waveform of a differential voltage between the scanning electrodes 19*a* and the sustaining electrodes 19*b*, a voltage in cells, and a light-emission waveform.

In the drawing, a solid line indicates the differential voltage applied between the scanning electrodes and the sustaining electrodes. A broken line indicates the voltage in cells, which means a total amount of a voltage when the applied voltage is added to the wall voltage.

A difference between the voltage in cells and the applied voltage corresponds to the wall voltage on the scanning electrodes. The light-emission waveform corresponds to an absolute value of a current that flows by discharging.

As shown in the drawing, in the initialization period, an initializing charge is generated in each discharge cell by applying a positive initialize pulse to all of the scanning electrodes $\mathbf{19}a_1$–$\mathbf{19}a_N$ at once. The initializing discharge is a weak discharge for initializing the wall charge in the discharge cells.

Specifically, a first half of the initialize pulse includes a positive ramp rise part. When the voltage in the cells becomes larger than a firing voltage Vf, the weak discharge (initializing discharge) starts in the discharge cells. The initializing discharge continues till the voltage starts to decrease, and the wall voltage is formed in the discharge cells with the initializing discharge (the wall charge that is negative at the scanning electrodes 19*a* is accumulated).

It is preferable that a slope of the ramps in the initialize pulse is in a range of 0.5–20 V/μs, because the weak discharge becomes on-and-off and thus unstable when the slope is less than 0.5 V/μs, and the discharge could easily become strong and not weak when the slope is more than 20 V/μs.

Further, it is preferable that the slope is 1 V/μs and above in terms of reduction in length of the initialization period. It is also preferable that the slope is 10 V/μs and less in terms of improvement of contrast by suppressing light emission.

A latter half of the initialize pulse includes a ramp fall part that falls until the polarity becomes negative. When an absolute value of the voltage in the cells becomes larger than the firing voltage Vf, a weak current due to the initializing discharge flows, and the wall voltage in the discharge cells are reduced. At a time when the initialization period ends, the absolute value of the voltage in the cells is adjusted to a value which is slightly lower than the firing voltage Vf.

In the address period, a voltage is selectively applied between the scanning electrodes $\mathbf{19}a_1$–$\mathbf{19}a_N$ and the data electrodes $\mathbf{14}_1$–$\mathbf{14}_M$. Specifically, a positive write pulse is applied to data electrodes selected from the data electrodes $\mathbf{14}_1$–$\mathbf{14}_M$ while a negative scan pulse is applied sequentially to each of the scanning electrodes $\mathbf{19}a_1$–$\mathbf{19}a_N$.

This causes a write discharge in the cells to be ignited and a wall charge is accumulated on the dielectric layer 13, writing one screen of pixel data.

In the sustain period, the data electrodes $\mathbf{14}_1$–$\mathbf{14}_M$ are grounded, and a positive sustain pulse is applied alternately to the scanning electrodes 19*a*1–19*a*N and the sustaining electrodes $\mathbf{19}b_1$–$\mathbf{19}b_N$.

By such a sustain operation, a discharge is caused in the discharge cells in which the wall charge is accumulated, when a potential of the surface of the dielectric layer on the sustaining electrodes exceeds the firing voltage Vf, and the discharge is maintained while the sustain pulse is applied.

As has been described, images are displayed by the discharge cells emitting light.

When the sustain discharge by the sustain pulse is finished, a wall charge having an opposite polarity of the applied sustain pulse is accumulated.

Specifically, when a positive sustain pulse is applied to the sustaining electrodes 19*b* at the end of the sustain period as shown in FIG. 4, a wall charge that is negative at the sustaining electrodes 19*b* (positive at the scanning electrodes 19*a*) is formed. On the other hand, when a positive sustain pulse is applied to the scanning electrodes 19*a* at the end of the sustain period, a wall charge that is negative at the scanning electrodes 19*a* (positive at the sustaining electrodes 19*b*) is accumulated.

In the discharge suspend period, an incomplete discharge is caused by applying an erase pulse, so as to stop the sustain discharge.

[Characteristics of Discharge Suspend Operation]

In a conventional driving method, the wall voltage in the discharge cells are completely erased in the erase period, in order to suppress an erroneous discharge due to interferences caused by such as noise and priming particles from other cells.

On the other hand, in the embodiments of the present invention, the erase pulse is applied in the discharge suspend period, so as to form the wall voltage that has a positive polarity at the scanning electrodes with respect to the sustaining electrodes. Specifically, the wall voltage is not completely erased, but maintained to a certain extent.

By forming the wall voltage having the positive polarity at the scanning electrodes with respect to the sustaining electrodes (the wall voltage having the same polarity as the initialize pulse), the voltage in the cells reaches the firing voltage Vf quickly, in comparison with the conventional method in which the wall voltage is completely erased by the erase pulse. Specifically, a time period tdset, the time period from application of the initialize pulse starts till the initializing discharge starts, becomes shorter, and accordingly a time period during which the initializing discharge is maintained becomes longer. This time period is indicated as S in FIG. 5 and herein after referred to as initializing discharge time S.

It is preferable that the wall voltage formed at the end of the discharge suspend period is 10 V or above, and the same as a minimum discharge sustain voltage Vmin-30 V or below (or 120 V or below). It is also preferable that the wall voltage formed at the end of the discharge suspend period is lower than the same that is formed while the sustain pulse is applied by 10 V or more.

When the wall voltage formed at the end of the discharge suspend period is lower than 10 V, it is not very effective. When the wall voltage formed at the end of the discharge suspend period is higher than the minimum discharge sustain voltage Vmin-30 V, the erroneous discharge is easily caused due to overvoltage by distortion such as ringing of the waveform.

The minimum discharge sustain voltage Vmin is a smallest necessary voltage to maintain the discharge between the scanning electrodes 19*a* and the sustaining electrodes 19*b*. Specifically, it indicates the voltage when the discharge cell begins to stop emitting light after the voltage is applied between a scanning electrode 19*a* and a sustaining electrode 19*b* of a PDP to cause a discharge cell to emit light, as the applied voltage gradually decreases.

By making the initializing discharge period S longer, effects such as followings can be obtained.

The initializing discharge starts in a vicinity of main gap at a center part of a cell, and gradually spreads to a peripheral area of the cell. With the spread, an amount of moving charge in the discharge cells increases, and an amount of wall charge at the end of initialization period increases.

Accordingly, if the initializing discharge period S is short, only the center part of each cell is initialized and the peripheral area of a cell is not initialized. In such a case, the address discharge becomes unstable in the succeeding address period, and the discharge probability decreases. Also, the deterioration of an image quality is caused by such as flickering of a screen due to lighting defect.

It is possible to improve the discharge probability if a driving voltage during the address operation can be set high. However, making a withstand voltage of power MOSFET high generally leads to a low throughput. For example, the withstand voltage of a data driver for driving with a pulse width about 1.0–1.5 μs is about 110 V. Accordingly, it is not practically possible to drive at a very high voltage.

On the other hand, if the initializing discharge period S is long, the peripheral area of a cell is initialized, and the address discharge becomes stable in the succeeding address period. Thus, the discharge probability increases and the image quality is improved.

It is preferable that the above described characteristics of the discharge suspend operation are applied to all discharge suspend periods that are preceding the initialization periods. For example, in a case in which each subfield includes an initialization period, it is preferable that the above characteristics of the discharge suspend operation is applied to all discharge suspend periods in the subfields, and in a case in which an initialization is included only in a first subfield in a field, the above characteristics of the discharge suspend operation is applied to a discharge suspend period in a last subfield in the field.

Note that it does not necessarily have to apply the characteristics to all discharge suspend periods that are preceding the initialization periods, and it is also possible that the above characteristics are applied to only a part of the discharge suspend periods when there are more than one discharge suspend period that precedes the initialization period.

In a first to ninth embodiments below, waveforms that are applied in the discharge suspend period will be explained in details.

FIRST EMBODIMENT

In the first embodiment, as shown in FIGS. 4 and 5, the positive sustain pulse (wave height Vsus) is applied at the sustaining electrodes 19*b*, and the wall charge that is negative at the sustaining electrodes 19*b* (positive at the scanning electrodes 19*a*) is accumulated. Further, in the initialization period, a positive initialize pulse is applied to the scanning electrodes $\mathbf{19}a_1$–$\mathbf{19}a_N$.

In the discharge suspend period, a rectangular pulse, which is positive at the scanning electrodes and having a wave height equal to the firing voltage Vf or lower, is applied between the scanning electrodes 19*a* and sustaining electrodes 19*b*. It is preferable that the pulse width of the rectangular pulse is set as short as 0.2 μs □ PWe □ 2.0 μs, and more preferably, 0.2 μs □ PWe □ 0.6 μs.

In the discharge suspend period, in order to apply a voltage between the scanning electrodes 19*a* and the sustaining electrodes 19*b* as shown in FIG. 5, a positive narrow rectangular pulse maybe applied to the scanning electrodes 19*a*, or a negative narrow rectangular pulse maybe applied to the sustaining electrodes 19*b*.

By setting the pulse width narrow, the applied voltage is removed before the erase discharge ends, i.e. during the erase discharge. In other words, the discharge is suspended before the wall charge positive at the scanning electrodes reverses its polarity, and accordingly, the wall charge positive at the scanning electrodes 19*a* is left. The polarity of the wall charge is the same as the polarity of the initialize pulse that is applied to the scanning electrodes 19*a* in the initialization period.

In an example of the present embodiment, a positive erase pulse with a pulse width PWe=0.5 μs was applied to the scanning electrodes 19*a*.

Figure 17:
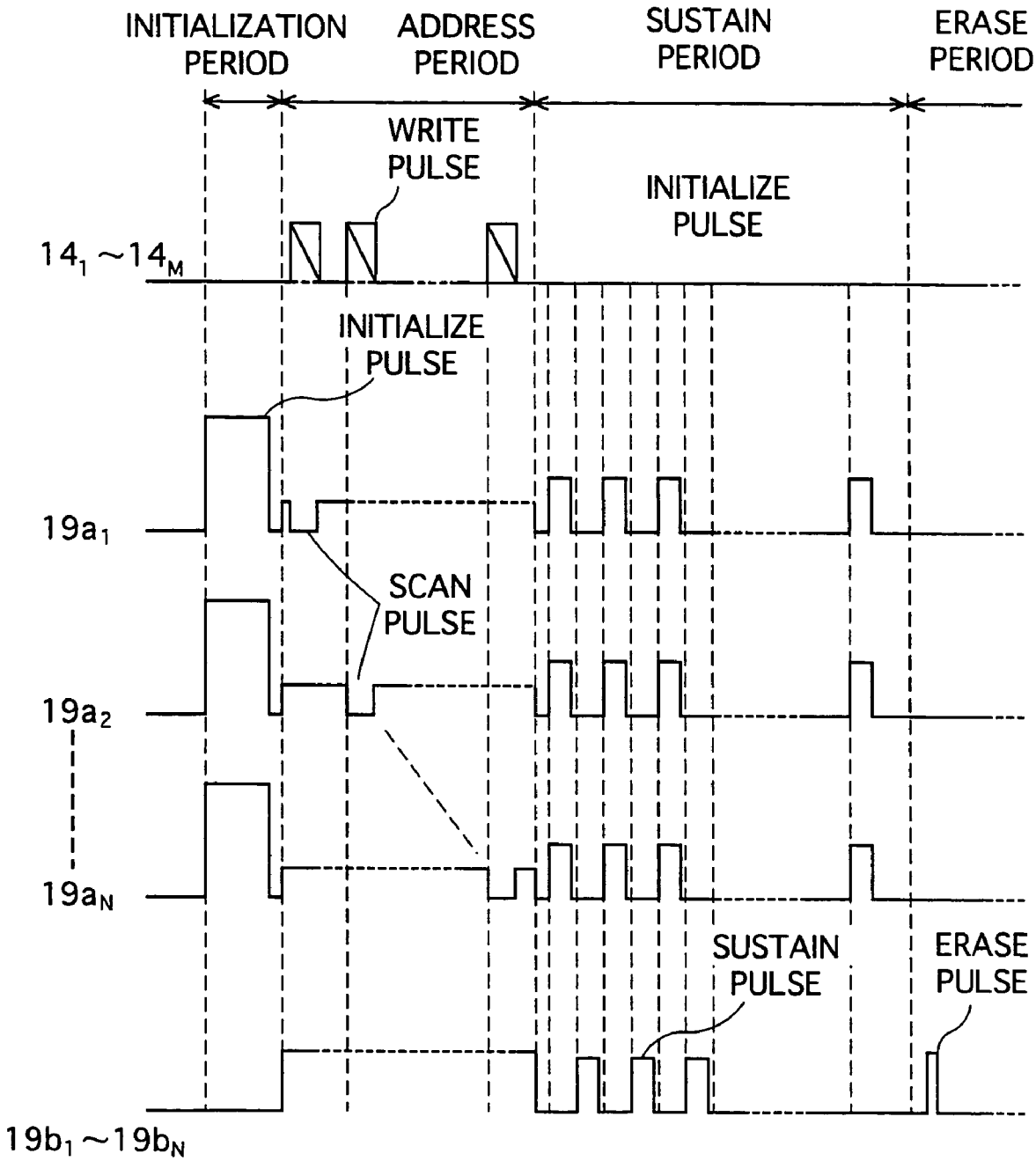
FIG. 17 shows a driving waveform of a voltage applied to each electrode in the PDP according to a conventional PDP.

On the other hand, in a comparative example, as shown in FIG. 17, a sustain pulse that is positive at the scanning electrodes 19*a* was applied at the end of the sustain period, and a wall voltage negative at the scanning electrodes 19*a* was formed. In the discharge suspend period, a positive erase pulse with a pulse width=0.5 μs was applied to the sustaining electrodes 19*b*. In this case, the wall voltage in the discharge cells was substantially erased. However, in a case in which the sustain pulse is driven in a high speed, the erase discharge becomes weak because the wall voltage after the sustain period decreases, and therefore it could happen that a negative wall voltage is formed at the scanning electrodes 19*a* at the end of the discharge suspend period.

Note that the same waveform shown in FIG. 4 was used for both the initialize pulse for both in the example and the comparative example.

Then, the time period tdset, the time period from application of the initialize pulse starts till the initializing discharge starts, a discharge probability Fadd [%], and an image quality were compared between the example of the present embodiment and the comparison example.

Results of the comparison are shown in Table 1 below.

TABLE 1

| | Pwe [μs] | tdset [μs] | Fadd [%] | Image Quality |
|---|---|---|---|---|
| Comparison Example | 0.5 | 50 | 92.0 | X (flickering) |
| First Embodiment | 0.5 | 30 | 99.0 | ○ |

While, in the comparison example, the time period tdset was around 50 μs, the discharge probability Fadd [%] was around 92%, and defects in image quality such as flickering was observed, in the first embodiment, the length of the time period tdset was shorter than the comparison example by 20 μs, the discharge probability Fadd [%] was improved up to around 99%, and the image quality was largely improved.

Note that reduction in the time period tdset, and improvement in the discharge probability and the image quality were also observed when the pulse width was in a range of 0.2 μs □ PWe □ 2.0 μs.

As has been explained above, by adopting the driving method according to the first embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

Although, in the examples shown in FIG. 4, a positive narrow pulse was applied to the scanning electrodes in the discharge suspend period, it is also possible to a negative narrow pulse to the sustaining electrodes, in order to apply a narrow pulse that is positive at the scanning electrodes with respect to the sustaining electrodes.

Further, although, in the examples shown in FIG. 4, a positive initialize pulse was applied to the scanning electrodes in the initialization period, it is also possible to a negative initialize pulse to the sustaining electrodes in the initialization period.

Further, in the present embodiment, a narrow pulse positive at the scanning electrodes with respect to the sustaining electrodes was applied in the discharge suspend period and a positive initialize pulse was applied to the scanning electrodes in the initialization period succeeding the discharge suspend period, it is also possible to apply a narrow pulse negative at the scanning electrodes with respect to the sustaining electrodes is applied in the discharge suspend period, and either a negative initialize pulse to the scanning electrodes or a positive initialize pulse to the sustaining electrodes is applied in the initialization period succeeding the discharge suspend period.

SECOND EMBODIMENT

Figure 6:
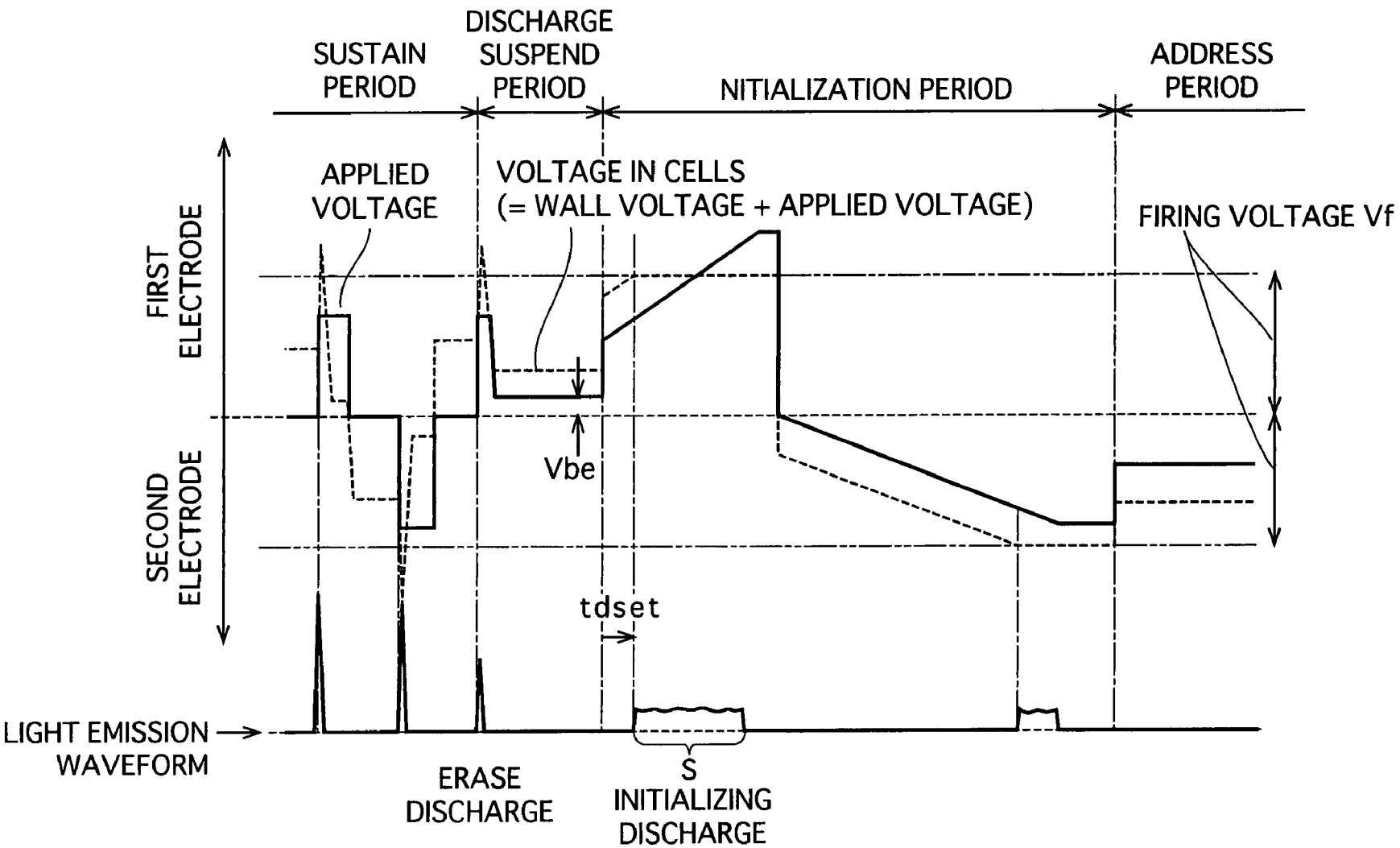
FIG. 6 is a time chart showing a waveform of a differential voltage between scanning electrodes and sustaining electrodes, a voltage in cells, and a light-emission waveform according to a second embodiment.

FIG. 6 is a time chart showing a waveform of a differential voltage between scanning electrodes and sustaining electrodes, a voltage in cells, and a light-emission waveform according to a second embodiment.

In the second embodiment, like the first embodiment, a last sustain pulse in the sustain period is applied to the sustaining electrodes 19*b*, and a wall charge that is negative at the sustaining electrodes 19*b* and positive at the scanning electrodes 19*a* is accumulated.

In the discharge suspend period succeeding the sustain period, the narrow pulse that is positive at the scanning electrodes 19*a* is applied between the scanning electrodes 19*a* and the sustaining electrodes 19*a*. The discharge is suspended before the polarity of the above wall charge reverses.

Further, in the initialization period, a positive polarity initialize pulse is applied to the scanning electrodes 19*a*1–19*a*N.

The above described characteristics are the same as the first embodiment. A difference in the present embodiment from the first embodiment is that a bias voltage positive at the scanning electrodes 19*a* is applied in the discharge suspend period at the same time during the above narrow rectangular pulse is applied.

The bias voltage is applied till the discharge suspend period is over, and accordingly, a start voltage of the initialize pulse becomes higher by an amount of the bias voltage.

It is preferable that the bias voltage Vbe is set in a range of (Vsus-50) □ Vbe □ (Vsus-15) [V], when a wave height of the sustain pulse is Vsus.

Figure 7A:
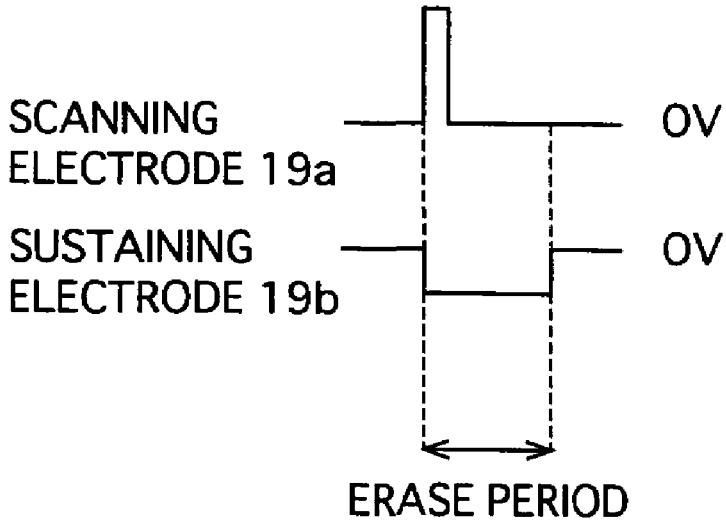
FIGS. 7A and 7B show a specific method of forming the differential voltage waveform.
Figure 7B:
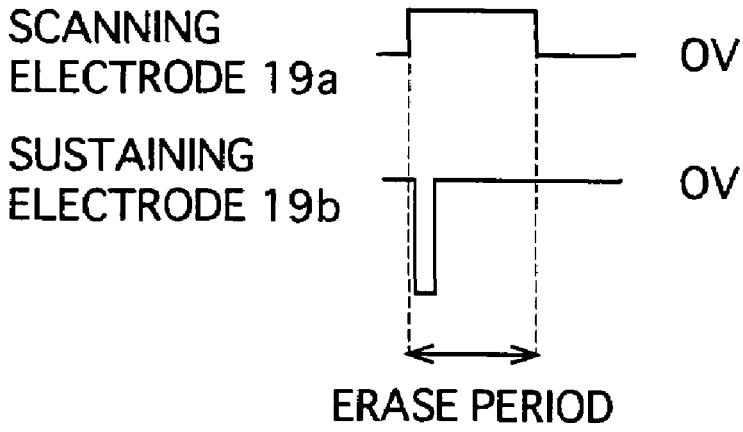

In order to apply a differential voltage waveform between the scanning electrodes 19*a* and the sustaining electrodes 19*b* as shown in FIG. 6 in the discharge suspend period, a positive narrow rectangular pulse may be applied to the scanning electrodes 19*a* at the same time when a negative wide rectangular pulse (wave height Vbe) is applied to the sustaining electrodes 19*b* as shown in FIG. 7A. It is also possible that, as shown in FIG. 7B, a positive wide rectangular pulse (wave height Vbe) is applied to the scanning electrodes 19*a* at the same time when a negative narrow rectangular pulse is applied to the sustaining electrodes 19*b*.

As has been described above, by applying a narrow rectangular pulse in the discharge suspend period at the same time when the bias voltage is applied, it is possible to leave a larger positive wall voltage on the scanning electrodes 19*a* by an amount of the bias voltage Vbe in comparison with a case in which only the narrow rectangular pulse is applied.

Accordingly, in comparison with the first embodiment, it is possible to reduce the length of the time period tdset, and makes the initializing discharge period S longer, and therefore the discharge probability of the address discharge is also improved.

In three examples of the second embodiment, a pulse width of the erase pulse was set as a pulse width PWe=0.5 μs, and the bias voltage Vbe in the discharge suspend period was set at 150 V, 130 V, and 165 V, respectively. The values for the comparison example were the same as in the comparison example in the first embodiment.

Then, the time period tdset, the discharge probability Fadd [%], and the image quality were compared among the examples of the first and second embodiments and the comparison example.

Results of the comparison are shown in Table 2 below.

TABLE 2

| | Pwe [μs] | Vbe [V] | tdset [μs] | Fadd [%] | Image Quality |
|---|---|---|---|---|---|
| Comparison Example | 0.5 | — | 50 | 92.0 | X (flickering) |
| First Embodiment | 0.5 | 0 | 30 | 99.0 | ○ |
| Second Embodiment | 0.5 | 150 | 25 | 99.5 | ◎ |
| | 0.5 | 130 | 20 | 99.8 | ◎ |
| | 0.5 | 165 | 17 | 99.9 | ◎ |

In the examples of the second embodiment, a length of tdset was reduced in comparison with the example of the first embodiment, and became shorter than the comparison example by 25 μs. The discharge probability Fadd [%] was also improved up to around 99.8 %, flickering in the display was substantially eliminated, and the image quality was largely improved.

Although the pulse width Pwe of the erase pulse was 0.5 μs in the example of the second embodiment, the present invention is not restricted to this. The same effect such as reduction of the time period tdset and improvements in the discharge probability and the image quality are achieved when the pulse width Pwe was in a range of 0.2 μs □ PWe □ 2.0 μs.

Further, the same effect such as reduction of the time period tdset and improvements in the discharge probability and the image quality are achieved when the bias voltage Vbe was in a range of Vsus-50) □ Vbe □ (Vsus-15) [V]

As has been explained above, by adopting the driving method according to the second embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the narrow pulse and the bias voltage that are positive at the scanning electrodes with respect to the sustaining electrodes were applied in the discharge suspend period, and the positive initialize pulse was applied to the scanning electrodes in the initialization period succeeding the discharge suspend period. However, it is also possible to adopt a method in which a narrow pulse and a bias voltage that are negative at the scanning electrodes with respect to the sustaining electrodes are applied in the discharge suspend period and either a negative initialize pulse to the scanning electrodes or a positive initialize pulse to the sustaining electrodes is applied in the initialization period succeeding the discharge suspend period.

THIRD EMBODIMENT

Figure 8:
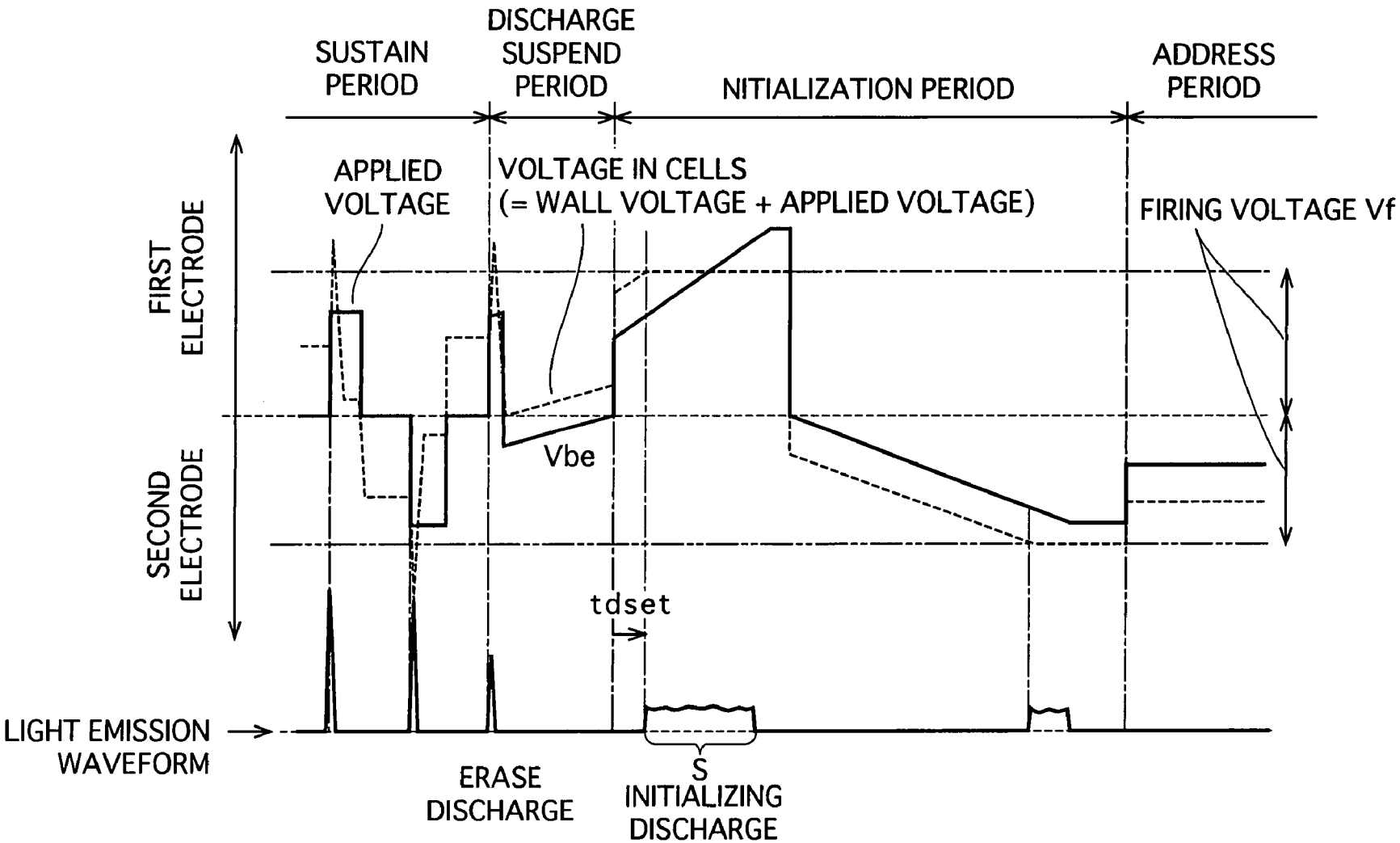
FIG. 8 is a time chart showing a waveform of a differential voltage between scanning electrodes and sustaining electrodes, a voltage in cells, and a light-emission waveform according to a third embodiment.

FIG. 8 is a time chart showing a waveform of a differential voltage between scanning electrodes and sustaining electrodes, a voltage in cells, and a light-emission waveform according to a third embodiment.

In the third embodiment, like the first and second embodiments, the last sustain pulse in the sustain period is applied to the sustaining electrodes 19*b*, and a wall charge negative at the sustaining electrodes 19*b* and positive at the scanning electrodes 19*a* is accumulated when the discharge period is over.

In the discharge suspend period succeeding the sustain period, the narrow pulse positive at the scanning electrodes 19*a* is applied between the scanning electrodes 19*a* and the sustaining electrodes 19*a*, and then the discharge is suspended.

Further, in the initialization period, a positive initialize pulse is applied to the scanning electrodes $19a_1$–$9a_N$. The above described characteristics are the same as the first embodiment. A difference in the present embodiment from the first embodiment is that a bias voltage that is negative at the scanning electrodes 19*a* with respect to the sustaining electrodes 19*b* and has a ramp rise part where the voltage gradually increases is applied in the discharge suspend period, and the above described narrow rectangular pulse is superimposed over the bias voltage.

According to a driving method of the present embodiment, even if the wall voltage is not formed after the narrow rectangular pulse has been applied in the discharge suspend period, it is possible to form a positive wall voltage without fail during the ramp rise part succeeding the discharge suspend period. Therefore, it is possible to form the wall voltage in a more stable manner in the discharge suspend period, in comparison with the above explained first and second embodiments.

It is preferable that the wall voltage formed at the end of the discharge suspend period is 10 V or above, and the same as a minimum discharge sustain voltage Vmin-40 V or below (or 110 V or below).

When the wall voltage formed at the end of the discharge suspend period is lower than 10 V, it is not very effective. When the wall voltage formed at the end of the discharge suspend period is higher than the minimum discharge sustain voltage Vmin-30 V, the erroneous discharge is easily caused due to overvoltage by distortion such as ringing of the waveform.

Further, it is preferable that the ratio of voltage shift at the ramp rise part is set in a range of 0.5–20 V/μs.

Figure 9A:
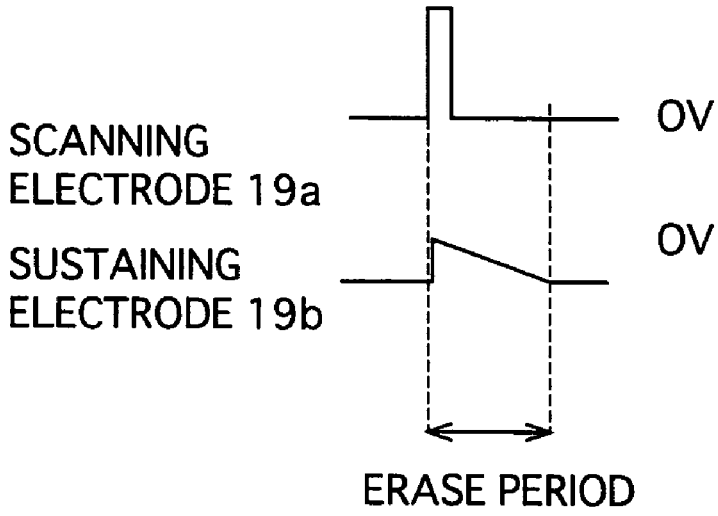
FIGS. 9A and 9B show a specific method of forming the differential voltage waveform.
Figure 9B:
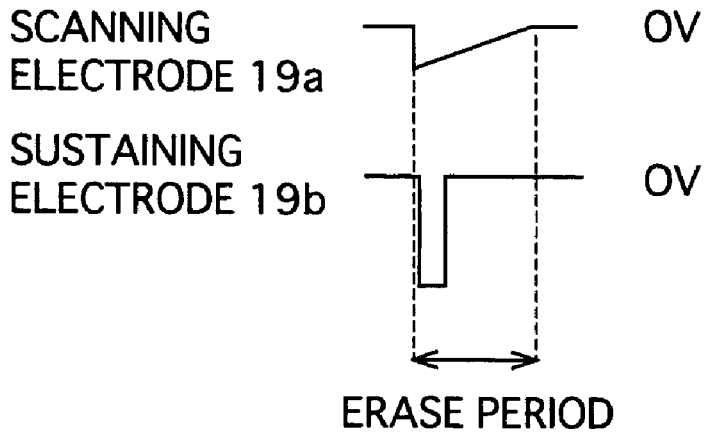

In order to apply a differential voltage waveform between the scanning electrodes 19*a* and the sustaining electrodes 19*b* as shown in FIG. 8 in the discharge suspend period, a positive narrow rectangular pulse may be applied to the scanning electrodes 19*a* at the same time when a positive wide pulse has a ramp fall that gradually decreases is applied to the sustaining electrodes 19*b* that as shown in FIG. 9A. It is also possible that, as shown in FIG. 9B, a positive wide pulse that has a ramp fall that gradually decreases is applied to the scanning electrodes 19*a* at the same time when a negative narrow rectangular pulse is applied to the sustaining electrodes 19*b*.

As has been explained above, by adopting the driving method according to the third embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the narrow pulse that is positive at the scanning electrodes with respect to the sustaining electrodes and the bias voltage that is negative at the scanning electrodes with respect to the sustaining electrodes and has a ramp rise part in which the voltage gradually increases were applied in the discharge suspend period, and the positive initialize pulse was applied to the scanning electrodes in the initialization period succeeding the discharge suspend period. However, it is also possible to adopt a method in which a narrow pulse that is negative at the scanning electrodes with respect to the sustaining electrodes and a bias voltage that is positive at the scanning electrodes with respect to the sustaining electrodes and has a ramp fall part in which the voltage gradually decreases are applied in the discharge suspend period and either a negative initialize pulse to the scanning electrodes or a positive initialize pulse to the sustaining electrodes is applied in-the initialization period succeeding the discharge suspend period.

FOURTH EMBODIMENT

Figure 10:
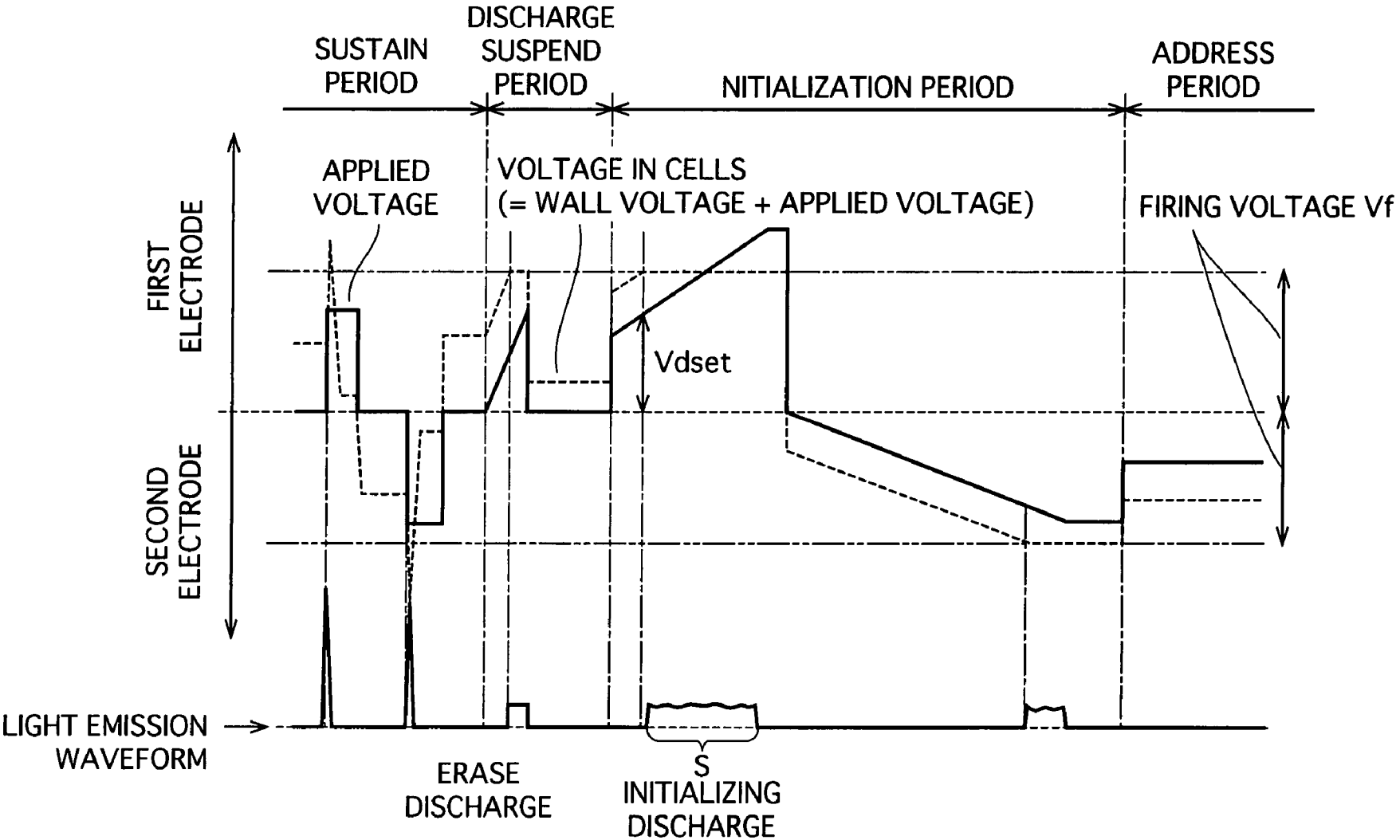
FIG. 10 is a time chart showing a waveform of a differential voltage between scanning electrodes and sustaining electrodes, a voltage in cells, and a light-emission waveform according to a fourth embodiment.

FIG. 10 is a time chart showing a waveform of a differential voltage between scanning electrodes and sustaining electrodes, a voltage in cells, and a light-emission waveform according to a fourth embodiment.

In the fourth embodiment, like the above described embodiments, the last sustain pulse in the sustain period is applied to the sustaining electrodes 19*b*, and a wall charge negative at the sustaining electrodes 19*b* and positive at the scanning electrodes 19*a* is accumulated when the discharge period is over.

In the discharge suspend period, the erase pulse that is positive at the scanning electrodes is applied between the scanning electrodes and the sustaining electrodes. In the initialization period, a positive initialize pulse is applied to the scanning electrodes $\mathbf{19}a_1$–$\mathbf{19}a_N$.

The above described characteristics are the same as the first embodiment. A difference in the present embodiment from the first embodiment is that the erase pulse applied in the present embodiment has a ramp waveform whose starting slope is αe [V/μs], while the erase pulse applied in the first embodiment is the narrow rectangular pulse.

The maximum voltage in the ramp waveform is set so as not to exceed the firing voltage Vf.

It is preferable that the starting slope αe [V/μs] is set in a range of 0.5 V/μs or above and 20 V/μs or below.

In the discharge suspend period, in order to apply a differential voltage between the scanning electrodes and the sustaining electrodes as shown in FIG. 10, a positive ramp pulse may be applied to the scanning electrodes 19*a*, or a negative ramp pulse maybe applied to the sustaining electrodes 19*b*.

The ramp waveform that has a ramp rise at the starting may be generated by using a Miller integrator and the like.

As has been described above, by applying the erase pulse having the ramp waveform in the discharge suspend period, it is possible to leave the wall voltage positive at the scanning electrodes 19*a* without fail in comparison with a case in which only the narrow rectangular pulses are applied.

Accordingly, in comparison with the first embodiment, it is possible to shorten the time period tdset, and makes the initializing discharge period S longer, and therefore the discharge probability of the address discharge is also improved.

Specifically, by applying the ramp waveform having a gradual rise as the erase pulse, a weak discharge is maintained during the starting rise of a voltage, and the wall voltage within the discharge cells is maintained at slightly below the firing voltage Vf. After the erase pulse stops, the wall voltage positive at the scanning electrodes is formed as shown by a broken line in FIG. 10. As has been described, it is possible to control an amount of the wall charge to be accumulated by using the ramp waveform.

In a case in which a wall voltage positive at the scanning electrodes is formed in the discharge suspend period, the voltage in the cells starts rising from a high voltage, and therefore a voltage Vdset when the initializing discharge starts is also reduced.

In an example of the second embodiment, a starting speed of a voltage in the ramp pulse as the erase pulse is set at 10 V/μs. The comparison example here was set the same as in the comparison example in the first embodiment.

Then, a voltage Vdset when the initializing discharge starts after the initialize pulse is applied, the discharge probability Fadd [%], and the image quality were compared between the example of the present embodiment and the comparison example.

Results of the comparison are shown in Table 3 below.

TABLE 3

| | Pwe [μs] | αe [V/μs] | Vdset [V] | Fadd [%] | Image Quality |
|---|---|---|---|---|---|
| Comparison Example | 0.5 | — | 290 | 92.0 | X (flickering) |
| Fourth Embodiment | 0.5 | 10 | 213 | 99.95 | ⊙ |

In the comparison example, Vdset was as high as 290 V, the discharge probability Fadd was around 92%, and degradation in the image quality such as flickering was observed. In the example of the present embodiment, Vdset lower by 77 V, the discharge probability Fadd was improved up to around 99.95%, flickering in the display was completely eliminated, and the image quality was largely improved.

Although the voltage starting speed of the ramp pulse was set at 10 V/μs, the same effect such as reduction of Vdset and improvements in the discharge probability and the image quality are achieved when the the voltage starting speed of the ramp pulse was set in a range of 0.5–20 V/μs.

As has been explained above, by adopting the driving method according to the fourth embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the ramp pulse positive at the scanning electrodes with respect to the sustaining electrodes was applied in the discharge suspend period, and the positive initialize pulse was applied to the scanning electrodes in the initialization period succeeding the discharge suspend period. However, it is also possible to adopt a method in which a ramp pulse negative at the scanning electrodes with respect to the sustaining electrodes is applied in the discharge suspend period and either a negative initialize pulse to the scanning electrodes or a positive initialize pulse to the sustaining electrodes is applied in the initialization period succeeding the discharge suspend period.

FIFTH EMBODIMENT

Figure 11:
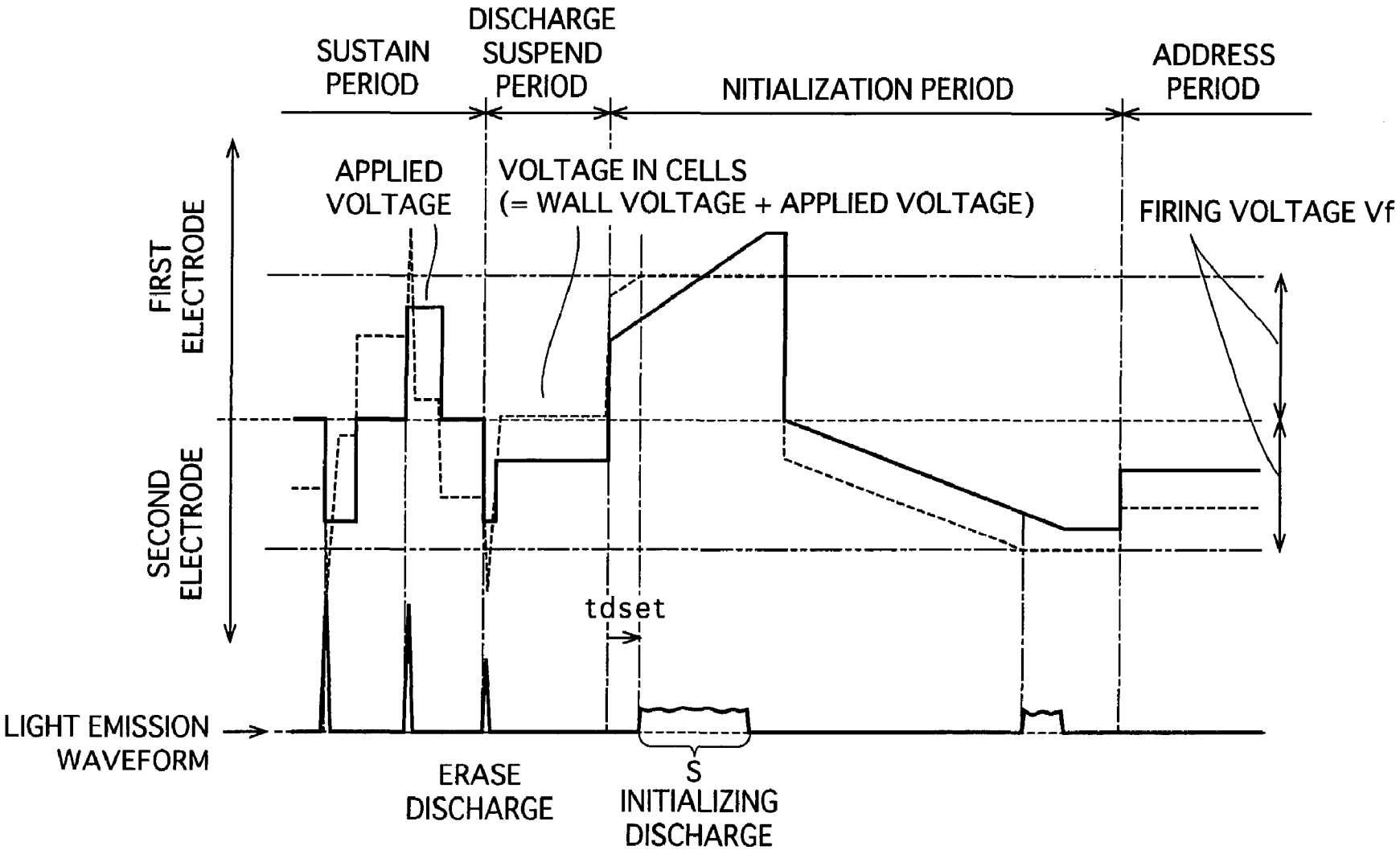
FIG. 11 is a time chart showing a wave form of a differential voltage between scanning electrodes and sustaining electrodes, a voltage in cells, and a light-emission waveform according to a fifth embodiment.

FIG. 11 is a time chart showing a waveform of a differential voltage between scanning electrodes and sustaining electrodes, a voltage in cells, and a light-emission waveform according to a fifth embodiment.

In the fifth embodiment, like the first embodiment, the positive initialize pulse is applied to the scanning electrodes $\mathbf{19}a_1$–$\mathbf{19}a_N$. However, in the present embodiment, by applying a positive sustain pulse to the scanning electrodes 19*a* at the end of the sustain period, the wall charge that is negative at the scanning electrodes 19*a* and positive at the sustaining electrodes 19*b* is accumulated.

In the discharge suspend period succeeding the sustain period, the bias voltage (Vbe) that is negative at the scanning electrodes 19*a* is applied between the scanning electrodes 19*a* and the sustaining electrodes 19*a*, and a narrow rectangular pulse that is negative at the scanning electrodes 19*a* is superimposed over the bias voltage, and thus the polarity of the wall charge is reversed.

It is preferable that the pulse width PWe of the rectangular pulse is in a range of 0.2–1.9 μs, and more preferably, 0.2–0.6 μs. The range of 0.2–1.9 μs is a range of 1.8 times larger than a half breadth of light emission peak (0.1–0.4 μs) of the erase discharge generated when the rectangular pulses are applied or more, and equal to or less than the pulse width of the sustain pulse.

Figure 12A:
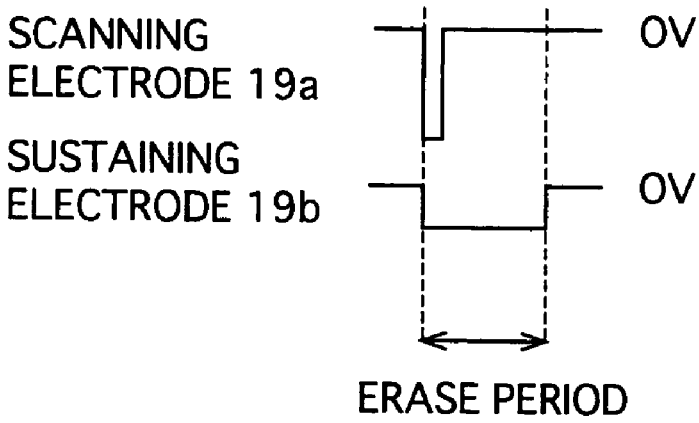
FIGS. 12A and 12B show a specific method of forming the differential voltage waveform.
Figure 12B:
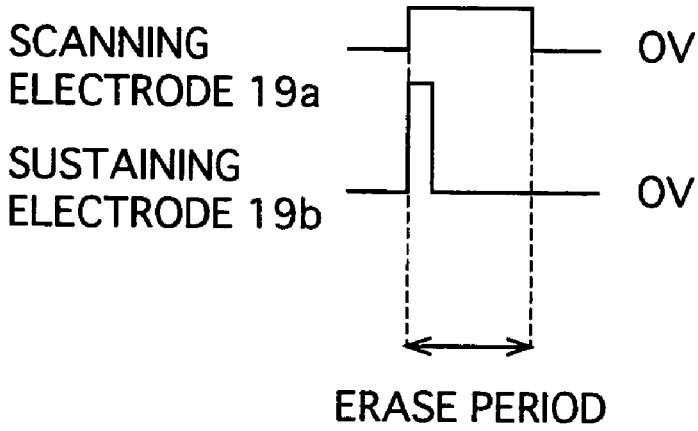

In order to apply a differential voltage waveform between the scanning electrodes 19*a* and the sustaining electrodes 19*b* as shown in FIG. 11 in the discharge suspend period, a negative narrow rectangular pulse may be applied to the scanning electrodes 19*a* at the same time when a negative wide rectangular pulse is applied to the sustaining electrodes 19*b* as shown in FIG. 12A. It is also possible that, as shown in FIG. 12B, a positive wide rectangular pulse is applied to the scanning electrodes 19*a* at the same time when a positive narrow rectangular pulse is applied to the sustaining electrodes 19*b*.

According to a driving method of the present embodiment, the rectangular pulse stops almost at the same time when the erase discharge ends, because the pulse width PWe is set as the above. Therefore, when the erase discharge ends, the voltage in the cells is substantially 0, and the positive wall voltage (Vbe) is formed on the scanning electrodes. Then, the bias voltage is removed and the positive wall voltage (Vbe) remains on the scanning electrodes 19*a*.

It is preferable that the wall voltage formed at the end of the discharge suspend period is 10 V or above, and the same as a minimum discharge sustain voltage Vmin-40 V or below (or 110 V or below).

When the wall voltage formed at the end of the discharge suspend period is lower than 10 V, it is not very effective. When the wall voltage formed at the end of the discharge suspend period is higher than the minimum discharge sustain voltage Vmin-30 V, the erroneous discharge is easily caused due to overvoltage by distortion such as ringing of the waveform.

In the present embodiment, as has been explained above, the wall voltage that has been negative on the scanning electrodes 19*a* at the end of the sustain period becomes positive on the scanning electrodes 19*a* at the end of the discharge suspend period. Accordingly, by adopting a method according to the present embodiment, the initializing discharge time S becomes longer in comparison with the conventional method in which the wall voltage is completely removed in the erase period.

As has been explained above, by adopting the driving method according to the fifth embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the narrow pulse bias and the voltage negative at the scanning electrodes with respect to the sustaining electrodes were applied in the discharge suspend period, and the positive initialize pulse was applied to the scanning electrodes in the initialization period succeeding the discharge suspend period. However, it is also possible to adopt a method in which a narrow pulse and a bias voltage that are positive at the scanning electrodes with respect to the sustaining electrodes are applied in the discharge suspend period, and either a negative initialize pulse to the scanning electrodes or a positive initialize pulse to the sustaining electrodes is applied in the initialization period succeeding the discharge suspend period.

SIXTH EMBODIMENT

Figure 13:
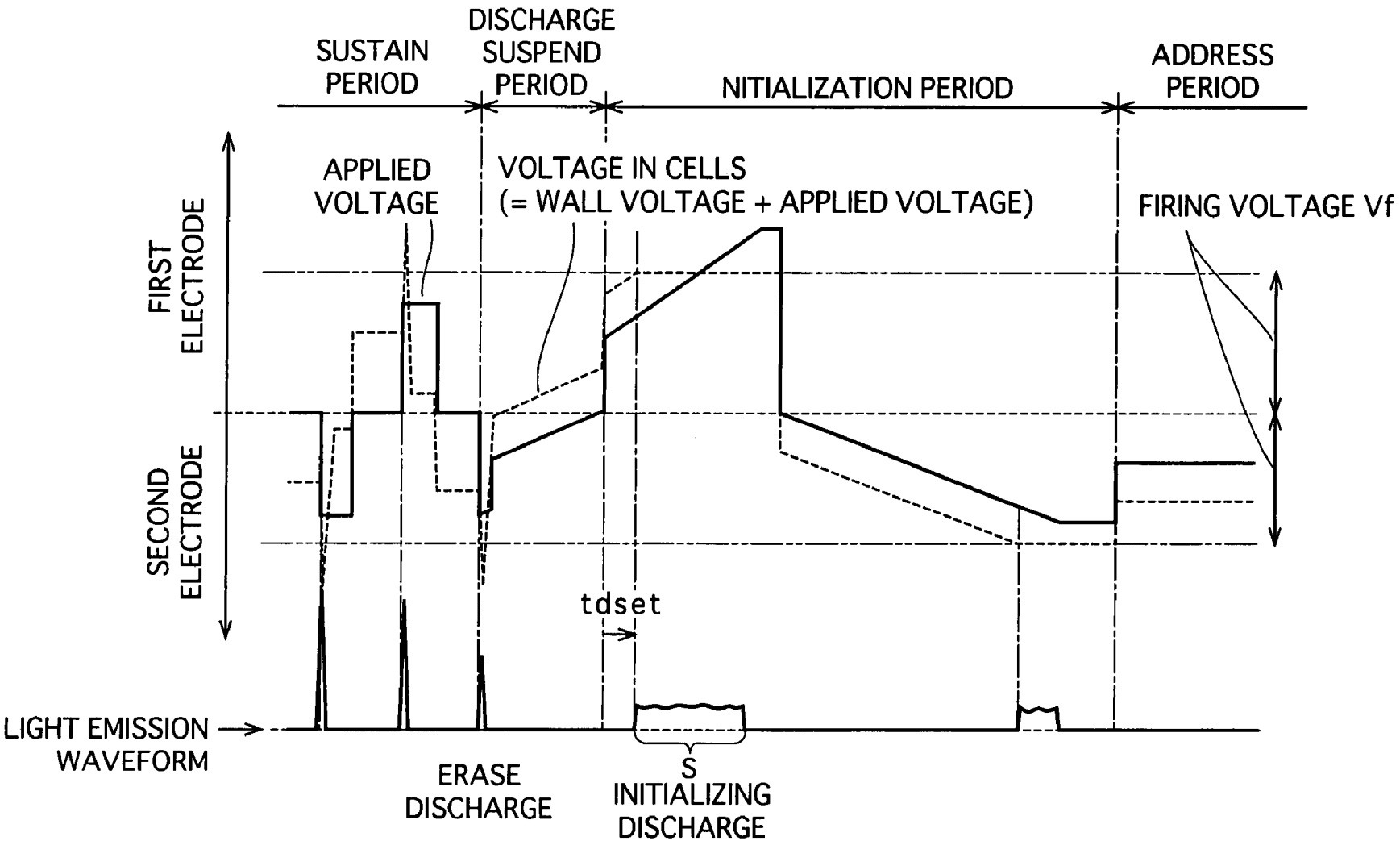
FIG. 13 is a time chart showing a waveform of a differential voltage between scanning electrodes and sustaining electrodes, a voltage in cells, and a light-emission waveform according to a sixth embodiment.

FIG. 13 is a time chart showing a waveform of a differential voltage between scanning electrodes and sustaining electrodes, a voltage in cells, and a light-emission waveform according to a sixth embodiment.

In the sixth embodiment, like the fifth embodiment, in the discharge suspend period, the bias voltage (Vbe) that is negative at the scanning electrodes 19*a* is applied between the scanning electrodes 19*a* and the sustaining electrodes 19*a*, and a narrow rectangular pulse that is negative at the scanning electrodes 19*a* is superimposed over the bias voltage, and thus the polarity of the wall charge is reversed, and the positive initialize pulse is applied to the scanning electrodes $\mathbf{19}a_1$–$\mathbf{19}a_N$.

The difference in the present embodiment from the fifth embodiment is that the bias voltage applied between the scanning electrodes 19*a* and the sustaining electrodes 19*b* has a ramp rise part where a voltage gradually increases.

Like the fifth embodiment, it is preferable that the wall voltage formed at the end of the discharge suspend period is 10 V or above, and the same as a minimum discharge sustain voltage Vmin-40 V or below (or 110 V and below).

It is also preferable that the voltage shift ratio of the ramp rise part is set in a range of 0.5–20 V/μs.

In order to apply a differential voltage waveform between the scanning electrodes 19*a* and the sustaining electrodes 19*b* as shown in FIG. 13 in the discharge suspend period, a negative narrow rectangular pulse may be applied to the scanning electrodes 19*a* at the same time when a negative wide pulse having a ramp part is applied to the sustaining electrodes 19*b*. It is also possible that a positive wide pulse having a ramp part is applied to the scanning electrodes 19*a* at the same time when a positive narrow rectangular pulse is applied to the sustaining electrodes 19*b*.

According to a driving method of the present embodiment, as with the fifth embodiment explained above, the positive wall voltage (Vbe) is formed on the scanning electrodes when the erase discharge ends, then the bias voltage is removed, and substantially all the wall voltage remains because the change in the voltage is gradual. Therefore, at the end of discharge suspend period, the positive voltage (Vbe) remains on the scanning electrodes 19*a* without fail.

Accordingly, it is ensured to make the initializing discharge period S longer.

As has been explained above, by adopting the driving method according to the sixth embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the narrow pulse and the bias voltage that are negative at the scanning electrodes with respect to the sustaining electrodes were applied in the discharge suspend period, and the positive initialize pulse was applied to the scanning electrodes in the initialization period succeeding the discharge suspend period. However, it is also possible to adopt a method in which a narrow pulse and a bias voltage that are positive at the scanning electrodes with respect to the sustaining electrodes are applied to the scanning electrodes in the discharge suspend period, and either a negative initialize pulse to the scanning electrodes or a positive initialize pulse to the sustaining electrodes is applied in the initialization period succeeding the discharge suspend period.

SEVENTH EMBODIMENT

Figure 14:
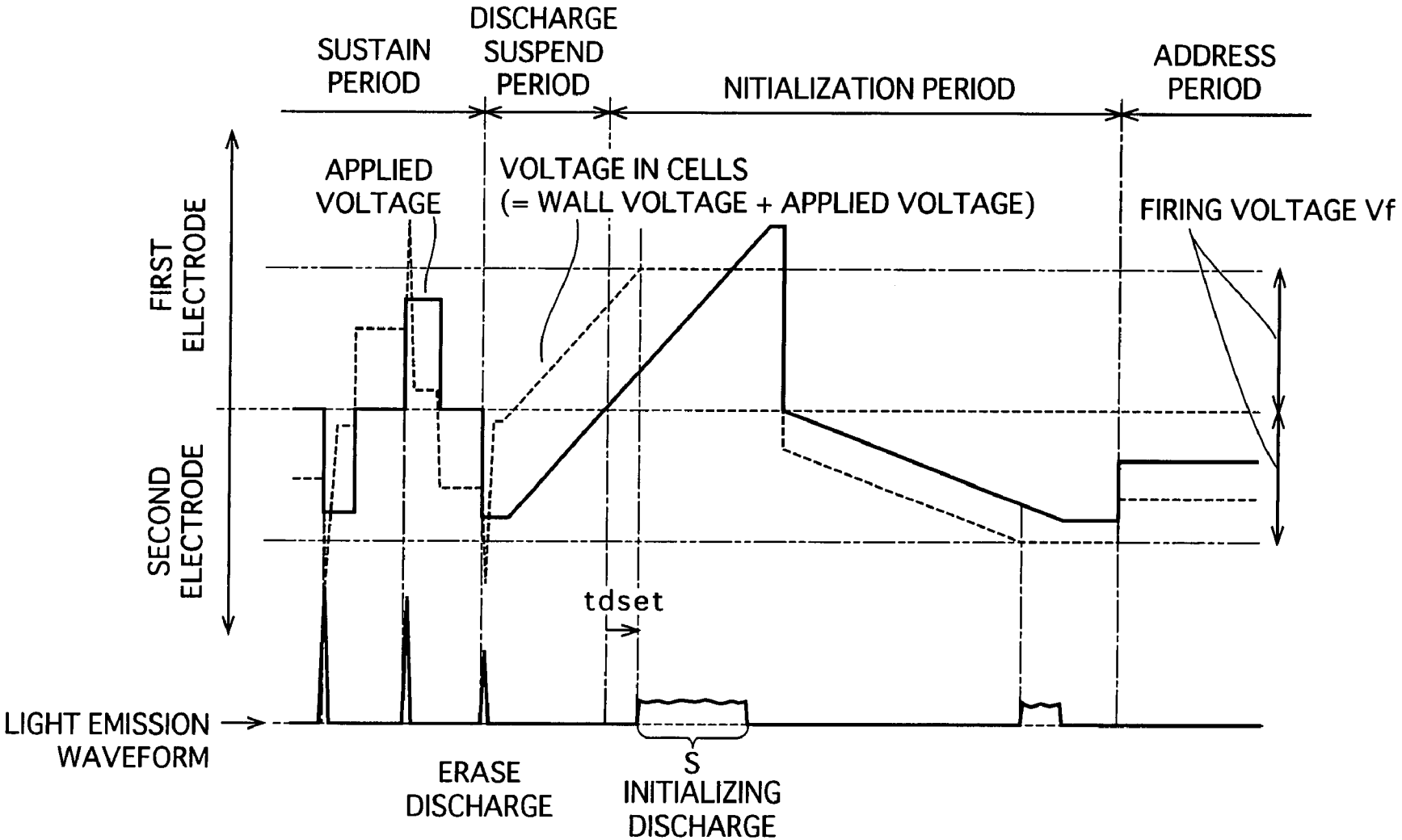
FIG. 14 is a time chart showing a waveform of a differential voltage between scanning electrodes and sustaining electrodes, a voltage in cells, and a light-emission waveform according to a seventh embodiment.

FIG. 14 is a time chart showing a waveform of a differential voltage between scanning electrodes and sustaining electrodes, a voltage in cells, and a light-emission waveform according to a seventh embodiment.

In the seventh embodiment, like the fifth and sixth embodiments, in the discharge suspend period, the bias voltage (Vbe) that is negative at the scanning electrodes 19*a* is applied between the scanning electrodes 19*a* and the sustaining electrodes 19*a*, and the polarity of the wall charge is reversed, and the positive initialize pulse is applied to the scanning electrodes $\mathbf{19}a_1$–$\mathbf{19}a_N$.

The difference in the present embodiment from the fifth and sixth embodiments is that a ramp pulse having a ramp fall toward an end of the pulse and whose wave height is equal to the firing voltage Vf or below is applied, although both the bias voltage and narrow rectangular pulses are applied between the scanning electrodes 19*a* and the sustaining electrodes 19*b* in the fifth and sixth embodiments.

It is preferable that the ramp fall of the ramp waveform is set around 10 V/μs, and more specifically, in a range of 0.5–20 V/μs.

In order to apply a differential voltage waveform between the scanning electrodes and the sustaining electrodes as shown in FIG. 14 in the discharge suspend period, a negative ramp pulse having the ramp fall toward the end of the pulse may be applied to the scanning electrodes 19*a*. It is also possible that a positive ramp pulse having the ramp fall toward the end of the pulse is applied to the sustaining electrodes 19*b*.

The ramp waveform having the ramp fall toward the end of the pulse may be generated by using the Miller integrator and the like.

As has been described above, by applying the erase pulse with the ramp waveform having the ramp fall toward the end of the pulse in the discharge suspend period, as with the above described sixth embodiment, the voltage in the cells becomes substantially 0 when the erase discharge ends, and the wall voltage positive at the scanning electrodes is formed, and therefore the wall voltage positive at the scanning electrodes 19*a* remains without fail. Accordingly, it is ensured to make the initializing discharge period S longer.

As has been explained above, by adopting the driving method according to the seventh embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

In the present embodiment, as shown in FIG. 14, the voltage shift is substantially constant, because a slope toward the end of the erase pulse is set at the same as a slope αset [V/μs] in the starting slope of the initialize pulse, and a part between the end of the erase pulse and the start of the initialize pulse is continuous. By this, discharge defect due to a sharp shift in voltage is suppressed, and the voltage in the cells (wall voltage) may be secured without fail.

Note that the slope toward the end of the erase pulse and the starting slope of the initialize pulse may be different, and the voltage may change discontinuously at the part between the end of the erase pulse and the start of the initialize pulse.

In an example of the seventh embodiment, a slope αset of both the slope toward the end of the erase pulse and the starting slope of the initialize pulse was set at 2.2 V/μs.

The comparison example was set the same as in the comparison example in the first embodiment.

Then, the time period tdset, the time period from application of the initialize pulse starts till the initializing discharge starts, an occurrence of discharge defects, a discharge probability Fadd [%], and an image quality were compared between the example of the present embodiment and the comparison example.

Results of the comparison are shown in Table 4 below.

TABLE 4

| | Pwe [μs] | αset [V/μs] | tdset [μs] | Discharge Defect | Fadd [%] | Image Quality |
|---|---|---|---|---|---|---|
| Comparison Example | 0.5 | — | 50 | YES | 92.0 | X (flickering) |
| Seventh Embodiment | 0.5 | 2.2 | 43 | NO | 98.1 | ○ |

In the comparison example, the time period tdset was about 50 μs, the discharge probability Fadd was around 92%, and the image degradation such as flickering was observed. However, in the example of the present embodiment, the time period tdset was shorter than that of the comparison example by 20 μs, the discharge probability Fadd was improved up to 98.1%, no discharge defect was observed, and the image quality was improved by suppressing the flickering.

Note that when αset was in a range of 0.5–20 V/μs, the same effects were achieved such as reduction of the length of tdset, improvement in the discharge probability Fadd, no discharge defect, and improvement in the image quality without any flickering.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the ramp pulse negative at the scanning electrodes with respect to the sustaining electrodes was applied in the discharge suspend period, and the initialize pulse positive at the scanning electrodes was applied in the initialization period succeeding the discharge suspend period. However, it is also possible to adopt a method in which a ramp pulse positive at the scanning electrodes with respect to the sustaining electrodes are applied in the discharge suspend period, and either a negative initialize pulse to the scanning electrodes or a positive initialize pulse to the sustaining electrodes is applied in the initialization period succeeding the discharge suspend period.

[EIGHTH EMBODIMENT]

Figure 15:
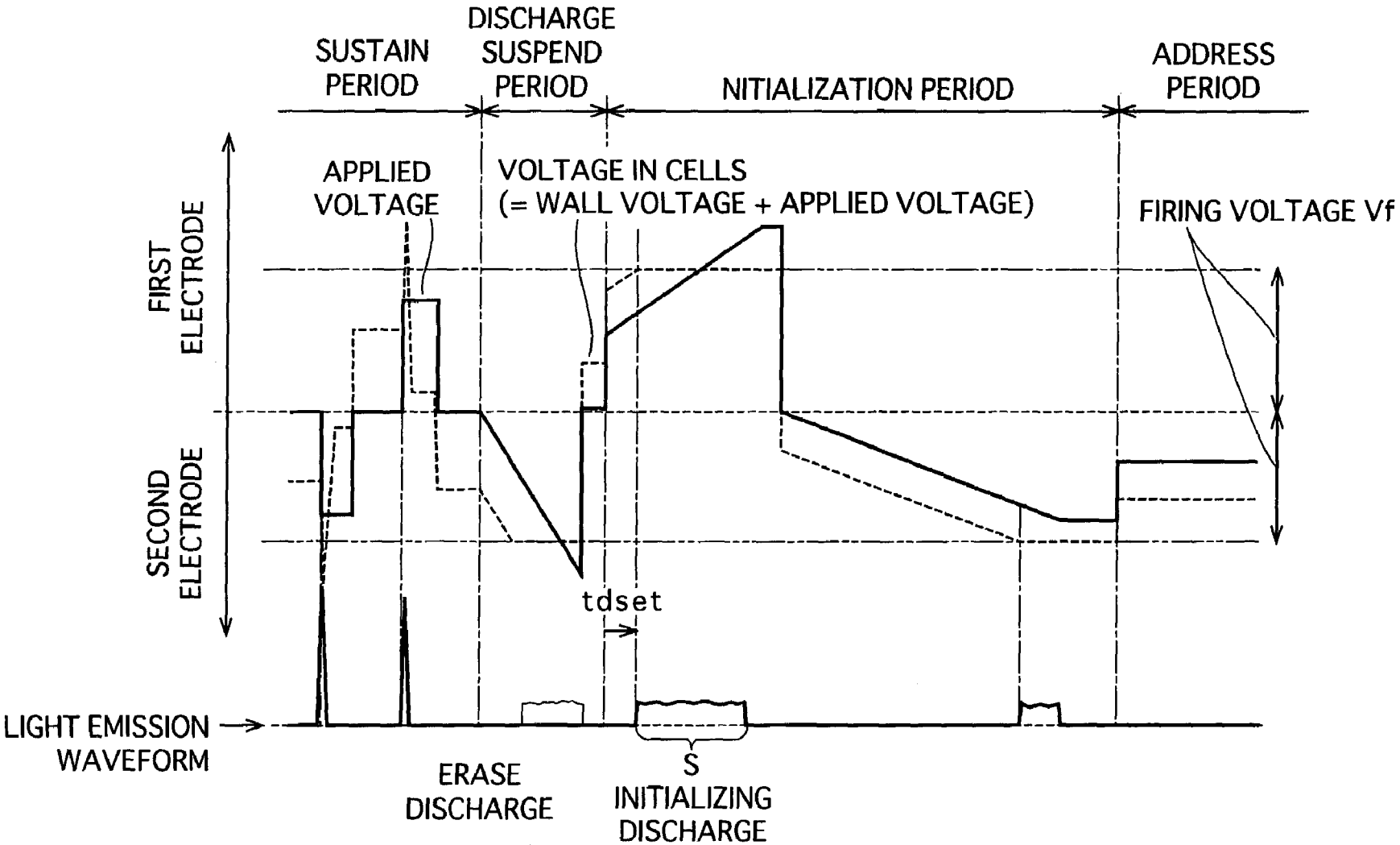
FIG. 15 is a time chart showing a waveform of a differential voltage between scanning electrodes and sustaining electrodes, a voltage in cells, and a light-emission waveform according to a eighth embodiment.

FIG. 15 is a time chart showing a waveform of a differential voltage between scanning electrodes and sustaining electrodes, a voltage in cells, and a light-emission waveform according to a eighth embodiment.

Also in the eighth embodiment, in the discharge suspend period, the bias voltage (Vbe) that is negative at the scanning electrodes 19*a* is applied between the scanning electrodes 19*a* and the sustaining electrodes 19*a*, and the polarity of the wall charge is reversed, and the positive initialize pulse is applied to the scanning electrodes $\mathbf{19}a_1$–$\mathbf{9}a_N$.

The difference in the present embodiment from the above explained embodiments is that an erase pulse having a ramp waveform with a starting ramp whose wave height is equal to the firing voltage Vf or above is applied.

It is preferable that the ramp rise of the ramp waveform is set in a range of 0.5–20 V/μs.

In order to apply a differential voltage waveform between the scanning electrodes and the sustaining electrodes as shown in FIG. 15 in the discharge suspend period, a ramp pulse that is negative and whose wave height is higher than the firing voltage Vf may be applied to the scanning electrodes 19*a*. It is also possible that a ramp pulse that is positive and whose wave height is higher than the firing voltage Vf is applied to the sustaining electrodes 19*b*.

By applying the erase pulse having the ramp waveform with a gradual ramp rise, a weak discharge is maintained at a voltage starting, and the wall voltage that is slightly below the firing voltage Vf is formed within the discharge cells. After the erase pulse stops, the wall voltage positive at the scanning electrodes is formed as shown by a broken line in FIG. 15.

In the present embodiment, as has been explained above, the wall voltage that has been negative at the scanning electrodes 19*a* at the end of the sustain period becomes positive at the scanning electrodes 19*a* at the end of the discharge suspend period.

Accordingly, by adopting a method according to the present embodiment, the initializing discharge period S becomes longer, in comparison with the conventional method in which the wall voltage is completely removed in the erase period.

Further, in the present embodiment, because the wall voltage is formed by a weak discharge, a value of the wall voltage to be formed can be easily controlled.

As has been explained above, by adopting the driving method according to the eighth embodiment, a wall voltage having the same polarity as the initialize pulse applied in the initialization period is left in the discharge suspend period, and the initializing discharge becomes longer. Accordingly, it is possible to realize a high speed and stable address operation and a high quality image display without write defects.

It is also possible in the present embodiment, instead of applying a positive initialize pulse to the scanning electrodes in the initialization period, to adopt a method in which a negative initialize pulse is applied to the sustaining electrodes in the initialization period.

Further, in the present embodiment, the ramp pulse negative at the scanning electrodes with respect to the sustaining electrodes was applied in the discharge suspend period, and the positive initialize pulse was applied to the scanning electrodes in the initialization period succeeding the discharge suspend period. However, it is also possible to adopt a method in which a ramp pulse positive at the scanning electrodes with respect to the sustaining electrodes are applied in the discharge suspend period, and either a negative initialize pulse to the scanning electrodes or a positive initialize pulse to the sustaining electrodes is applied in the initialization period succeeding the discharge suspend period.

[NINTH EMBODIMENT]

A driving waveform in a plasma display device according to a ninth embodiment is the same as the waveform in the third embodiment. A difference of the present invention from the third embodiment is that a PDP according to the present embodiment has an electrode structure in which the scanning electrodes 19*a* and the sustaining electrodes 19*b* are divided into a plurality of lines in a discharge cell.

Figure 16:
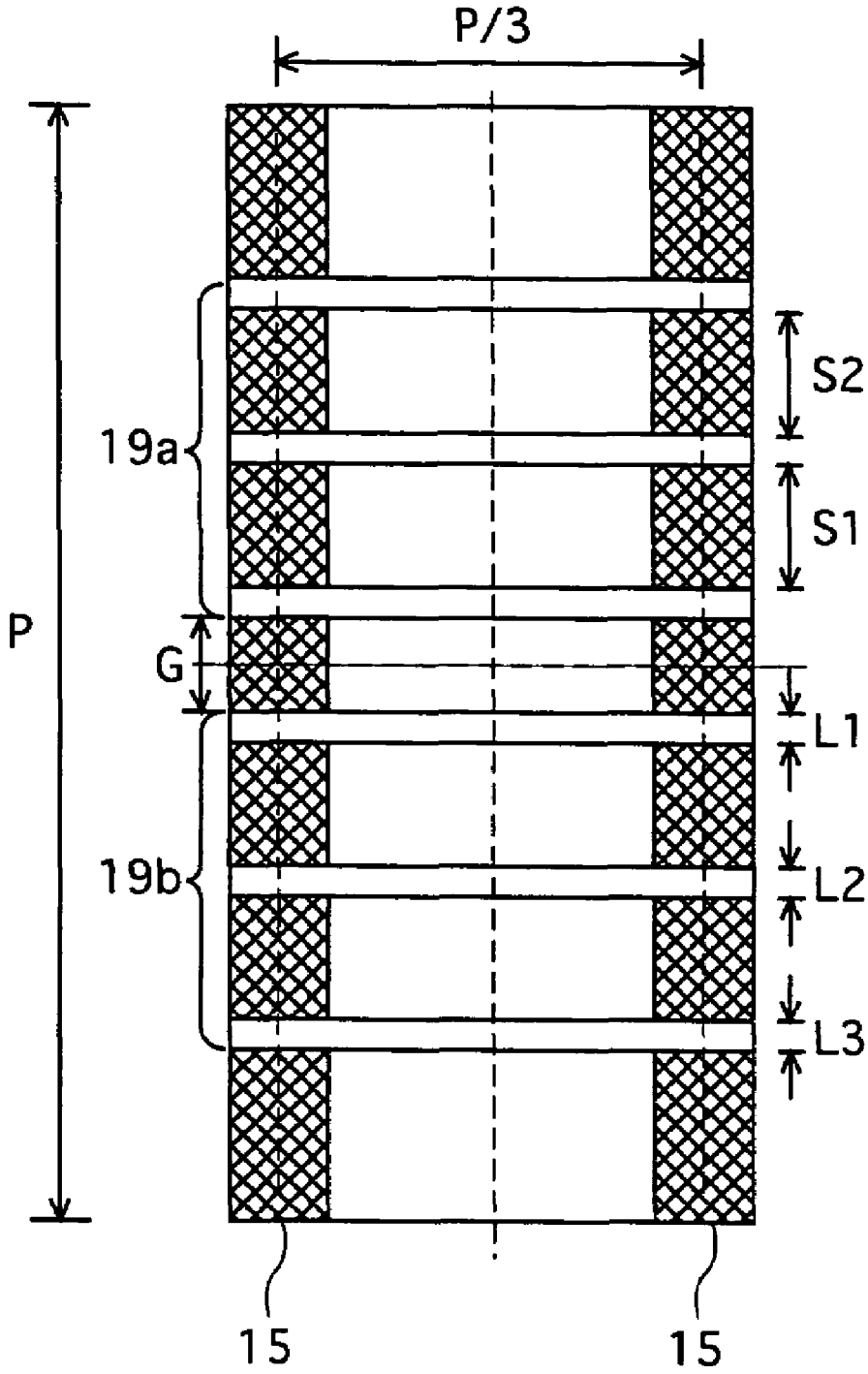
FIG. 16 is a perspective view schematically illustrating an electrode structure of a PDP relates to a ninth embodiment.

FIG. 16 is a perspective view schematically illustrating an electrode structure of a PDP relates to a ninth embodiment.

Generally, when using a PDP having the electrode structure in which the electrodes are divided into a plurality of lines in a discharge cell as shown in FIG. 16, it is possible to make an electrostatic capacity smaller by reducing surface areas of electrodes at the same time increasing a size of the discharge, in comparison with a case in which the wide transparent electrodes are used. Accordingly, the discharge probability improves because discharge current per sustain pulse decreases.

On the other hand, the electrodes in the divided structure are discontinuous in a widthwise direction, and it takes a long time for discharge plasma generated in a main discharge gap to spread to outer edges of the electrodes. Accordingly, a time length from the address discharge starts till it ends during the address period extends, and the half breadth of the light-emission waveform and a peak waveform of the discharge current are tend to become wider, and thus the discharge delay becomes larger.

Accordingly, a problem is noted that the PDP having electrodes with the divided structure is susceptible to write defect and degradation of the image quality, especially when a length of the address pulse is reduced in high definition display.

In order to solve the above problem, in the ninth embodiment, because the wall voltage positive at the scanning electrodes 19*a* is formed at the end of the discharge suspend period, Vdset when the initialize pulse is applied in the initialization period decreases, and the initializing discharge time S becomes longer.

By doing so, the initializing discharge sufficiently expands to the outer edges of the divided electrodes, and the wall charge is accumulated on the outer electrodes at the end of the initialization period. Accordingly, the discharge probability in the address discharge increases and the write defects are suppressed.

Thus, by adopting the present embodiment, a plasma display device having an excellent discharge probability and little write defect can be achieved.

In PDPs used for an example of the present embodiment and the comparison example, an interval between line electrodes for both the scanning electrodes 19*a* and the sustaining electrodes 19*b* becomes narrower in arithmetical progression as it becomes distant from the main discharge gap. Lengths for parts in the electrodes were as follows: pixel pitch=0.675 mm, main discharge gap G=80 μm, electrode width L1 and L2=35 μm, L3=45 μm, first electrode interval S1=45 μm, second electrode interval S2=35 μm.

Then the PDPs were driven by using the driving waveforms in the above example of the third embodiment in which the tilt in ramp waveform is 10 v/μm, and in the comparison example.

Then, a voltage Vdset when the initializing discharge starts after the initialize pulse is applied, the discharge probability Fadd [%], and the image quality were compared between the example of the present embodiment and the comparison example.

Results of the comparison are shown in Table 5 below.

TABLE 5

| | Pwe [μs] | αe [V/μs] | Vdset [V] | Fadd [%] | Image Quality |
|---|---|---|---|---|---|
| Comparison Example | 0.5 | — | 356 | 86.0 | X (flickering) |
| Fourth Embodiment | 0.5 | 10 | 217 | 99.9 | ⊙ |

While Vdset was as high as 356 V, the discharge probability Fadd [%] was around 86%, and flickering was intense and the image quality was low in the comparison example, Vdset was lower than that of the comparison example by about 140 V, the discharge probability Fadd [%] was improved up to around 99.9%, and the image quality was largely improved without any flickering in the example of the ninth embodiment.

Although the voltage starting speed of the ramp pulse was set at 10 V/μs, the same effect such as reduction of Vdset and improvements in the discharge probability and the image quality are achieved when the the voltage starting speed of the ramp pulse was set in a range of 0.5–20 V/μs.

As has been explained above, by adopting the driving method according to the present embodiment, it is possible to realize a high speed and stable address operation and a high quality image display without write defects, even when using divided electrodes.

Although in the example of the present embodiment, the electrode structure was employed, in which electrodes that has been divided into four lines in a discharge cell as the scanning electrodes 19*a* and the sustaining electrodes 19*b*, the same effect such as reduction of Vdset and improvements in the discharge probability and the image quality are also achieved when an electrode structure is employed, in which electrodes that has been divided into 2–6 lines in a discharge cell as the scanning electrodes 19*a* and the sustaining electrodes 19*b*.

Although the explanation of the present embodiment is made using the same drive waveform as in the third embodiment, the driving waveforms disclosed in any of the above first to eighth embodiments may be used as well.

INDUSTRIAL APPLICABILITY

A PDP according to the present invention may be used as the display screen for computers, televisions and the like, especially, as displays that are large in size.

The invention claimed is:

1. A plasma display device comprising a plasma display panel and a driving unit that drives the plasma display panel, the plasma display panel having a first substrate on which a plurality of pairs of a first electrode and a second electrode are disposed and a second substrate on which a plurality of third electrodes are disposed, a plurality of discharge cells being formed between the first and second substrates so as to each include a part of each of the first, second, and third electrodes, wherein the driving unit:

(a) repeatedly provides, in order for the plasma display panel to display one frame of image, (i) an address period in which a wall charge is accumulated in one or more of the discharge cells by selectively applying pulses to the first and third electrodes, (ii) a sustain period that succeeds the address period and in which the selected discharge cells are discharged by applying a sustain pulse between the first and second electrodes, a polarity of the sustain pulse at the first electrodes with respect to the second electrodes alternating between positive and negative, and (iii) a discharge suspend period in which the discharging of the selected discharge cells is suspended, (b) provides at least one initialization period that succeeds the discharge suspend period and in which an initialize pulse is applied to the first electrodes to initialize the wall charge in the discharge cells, (c) applies a voltage between the first and second electrodes in the discharge suspend period, so as to form a wall voltage whose polarity at the first electrodes with respect to the second electrodes is the same as that of the initialize pulse, and (d) applies an erase pulse between the first and second electrodes in the discharge suspend period, the erase pulse being negative in polarity at the first electrodes with respect to the second electrodes, having a starting ramp immediately after application of the erase pulse is commenced, and higher in wave height than a discharge firing voltage.

2. A plasma display device according to claim 1, wherein an absolute value of the wall voltage formed between the first and second electrodes in the discharge suspend period is in a range from 10 V to (Vmin-30) V inclusive, where Vmin indicates a minimum discharge sustain voltage that is required to sustain a discharge between the first and the second electrodes.

3. A plasma display device according to claim 1, wherein a polarity of the initialize pulse applied in the initialization period is positive, the polarity of the sustain pulse is negative at an end of the sustain period, and a voltage between the first and second electrodes in the discharge suspend period is applied so that a wall voltage formed in the sustain period partially remains.

4. A plasma display device according to claim 3, wherein a pulse width of the erase pulse is 0.2 μs to 2.0 μs inclusive.

5. A plasma display device according to claim 3, wherein the driving unit applies a bias voltage between the first and second electrodes in the discharge suspend period at the same time when the erase pulse is applied, the bias voltage being positive in polarity at the first electrodes with respect to the second electrode and lower in wave height than the sustain pulse.

6. A plasma display device according to claim 5, wherein an absolute value of the bias voltage is in a range from 10 V to (Vmin-40) V inclusive, where Vmin indicates a minimum discharge sustain voltage that is required to sustain a discharge between the first and the second electrodes.

7. A plasma display device according to claim 5, wherein a waveform of the bias voltage has a ramp rise part, in which the voltage gradually increases after the erase pulse has ended.

8. A plasma display device according to claim 3, wherein a starting speed of the erase pulse is 0.5 V/μs to 20 V/μs inclusive.

9. A plasma display device according to claim 1, wherein a polarity of the initialize pulse applied in the initialization period is positive, the polarity of the sustain pulse is positive at an end of the sustain period, and a voltage between the first and second electrodes in the discharge suspend period is applied so that a polarity of a wall voltage formed in the sustain period is reversed.

10. A plasma display device according to claim 9, wherein the erase pulse is narrower in pulse width than the sustain pulse.

11. A plasma display device according to claim 10, wherein a pulse width of the erase pulse is 0.2 μs to 2.0 μs inclusive.

12. A plasma display device according to claim 9, wherein the driving unit applies a bias voltage between the first and second electrodes in the discharge suspend period at the same time when the erase pulse is applied, the bias voltage being negative in polarity at the first electrodes with respect to the second electrode and lower in wave height than the sustain pulse.

13. A plasma display device according to claim 12, wherein a waveform of the bias voltage has a ramp rise part, in which the voltage gradually increases after the erase pulse has ended.

14. A plasma display device according to claim 9, wherein the erase pulse has an ending ramp immediately before the initialization period starts.

15. A plasma display device according to claim 14, wherein waveforms of the ending ramp of the erase pulse and a starting ramp of the initialize pulse are continuous.

16. A plasma display device according to any of claims 1 to 3, 4 to 7, and 8 to 15, wherein each of the first and second electrodes in the discharge cells is divided into a plurality of electrode lines along a lengthwise direction.

17. A method of driving a plasma display device comprising a plasma display panel and a driving unit that drives the plasma display panel, the plasma display panel having a first substrate on which a plurality of pairs of a first electrode and a second electrode are disposed and a second substrate on which a plurality of third electrodes are disposed, a plurality of discharge cells being formed between the first and second substrates so as to each include a part of the first, second, and third electrodes, respectively, wherein one frame of an image is displayed by repeatedly providing (i) an address period in which a wall charge is accumulated in one or more of the discharge cells by selectively applying pulses to the first and third electrodes, (ii) a sustain period that succeeds the address period and in which the selected discharge cells are discharged by applying a sustain pulse between the first and second electrodes, a polarity of the sustain pulse at the first electrodes with respect to the second electrodes alternating between positive and negative, and (iii) a discharge suspend period in which the discharging of the selected discharge cells is suspended, at least one initialization period, in which an initialize pulse is applied to the first electrodes to initialize the wall charge in the discharge cells, is provided succeeding the discharge suspend period, a voltage is applied between the first and second electrodes in the discharge suspend period, so as to form a wall voltage whose polarity at the first electrodes with respect to the second electrodes is the same as that of the initialize pulse, and an erase pulse is applied between the first and second electrodes in the discharge suspend period, the erase pulse being negative in polarity at the first electrodes with respect to the second electrodes, having a starting ramp immediately after application of the erase pulse is commenced, and higher in wave height than a discharge firing voltage.

18. A method according to claim 17, wherein an absolute value of the wall voltage formed between the first and second electrodes in the discharge suspend period is in a range from 10 V to (Vmin-30) V inclusive, where Vmin indicates a minimum discharge sustain voltage that is required to sustain a discharge between the first and the second electrodes.

19. A method according to claim 17, wherein a polarity of the initialize pulse applied in the initialization period is positive, the polarity of the sustain pulse is negative at an end of the sustain period, and a voltage between the first and second electrodes in the discharge suspend period is applied so that a wall voltage finned in the sustain period partially remains.

20. A method according to claim 19, wherein a pulse width of the erase pulse applied in the discharge suspend period is 0.2 μs to 2.0 μs inclusive.

21. A method according to claim 19, wherein a bias voltage is applied between the first and second electrodes in the discharge suspend period at the same time when the erase pulse is applied, the bias voltage being positive in polarity at the first electrodes with respect to the second electrode and lower in wave height than the sustain pulse.

22. A method according to claim 21, wherein an absolute value of the bias voltage is in a range from 10 V to (Vmin-40) V inclusive, where Vmin indicates a minimum discharge sustain voltage that is required to sustain a discharge between the first and the second electrodes.

23. A method according to claim 21, wherein a waveform of the bias voltage has a ramp rise part, in which the voltage gradually increases after the erase pulse has ended.

24. A method according to claim 19, wherein a starting speed of the erase pulse is applied in the discharge suspend period is 0.5 V/μs to 20 V/μs inclusive.

25. A method according to claim 17, wherein a polarity of the initialize pulse applied in the initialization period is positive, the polarity of the sustain pulse is positive at an end of the sustain period, and a voltage is applied between the first and second electrodes in the discharge suspend period so that a polarity of a wall voltage formed in the sustain period is reversed.

26. A method according to claim 25, wherein the erase pulse is narrower in pulse width than the sustain pulse.

27. A method according to claim 26, wherein a pulse width of the erase pulse applied in the discharge suspend period is 0.2 μs to 2.0 μs inclusive.

28. A method according to claim 25, wherein a bias voltage is applied between the first and second electrodes in the discharge suspend period at the same time when the erase pulse is applied, the bias voltage being negative in polarity at the first electrodes with respect to the second electrode and lower in wave height than the sustain pulse.

29. A method according to claim 28, wherein a waveform of the bias voltage applied between the first and second electrodes has a ramp rise part, in which the voltage gradually increases after the erase pulse has ended.

30. A method according to claim 25, wherein the erase pulse has an ending ramp immediately before the initialization period starts.

31. A method according to claim 30, wherein waveforms of the ending ramp of the erase pulse and a starting ramp of the initialize pulse are continuous.

* * * * *